US010492526B2

(12) United States Patent
Sampson et al.

(10) Patent No.: US 10,492,526 B2
(45) Date of Patent: Dec. 3, 2019

(54) INHALATION DEVICE AND INHALANT APPARATUS

(71) Applicant: British American Tobacco (Investments) Limited, London (GB)

(72) Inventors: John Sampson, London (GB); Rabya Khan-Dar, London (GB); Simon Rucker, London (GB); Charles Dillon, Cambridge (GB); Simon James Smith, Cambridge (GB); Carl Clement, Cambridge (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 561 days.

(21) Appl. No.: 14/771,113

(22) PCT Filed: Feb. 24, 2014

(86) PCT No.: PCT/GB2014/050545
§ 371 (c)(1),
(2) Date: Aug. 27, 2015

(87) PCT Pub. No.: WO2014/132045
PCT Pub. Date: Sep. 4, 2014

(65) Prior Publication Data

US 2016/0007649 A1 Jan. 14, 2016

(30) Foreign Application Priority Data

Feb. 27, 2013 (GB) ..... 1303433.5

(51) Int. Cl.
*A24F 7/00* (2006.01)
*A24F 13/06* (2006.01)
(Continued)

(52) U.S. Cl.
CPC ..... *A24F 13/06* (2013.01); *A24D 3/041* (2013.01); *A24D 3/043* (2013.01); *A24F 7/02* (2013.01);
(Continued)

(58) Field of Classification Search
None
See application file for complete search history.

(56) References Cited

U.S. PATENT DOCUMENTS 2,153,623 A 4/1939 Jacobson
2,956,568 A 10/1960 Knudsen
(Continued)

FOREIGN PATENT DOCUMENTS

CN 2262810 Y 9/1997
CN 2686350 Y 3/2005
(Continued)

OTHER PUBLICATIONS

International Search Report and Written Opinion, dated Oct. 8, 2014, for International Application No. PCT/GB2014/050545.
(Continued)

*Primary Examiner* — Eric Yaary
(74) *Attorney, Agent, or Firm* — Patterson Thuente Pedersen, P.A.

(57) ABSTRACT

An inhalation device to hold an inhalant-generating component to generate an inhalant to be drawn through the device and inhaled by a user. The device has a body (10) having a first open end (11*b*) configured to receive an inhalant-generating component and, a second open end (11*a*) in fluid communication with the first end through which a user may draw inhalant from the inhalant-generating component. The body is configured to receive a flavour delivery component (63) having an organoleptic material to selectively allow or prevent addition of an organoleptic
(Continued)

additive into an inhalant stream drawn through the device. The device includes a ventilation control mechanism (15) configured to selectively allow different amounts of ambient air into the body to mix with and dilute the inhalant stream as it is drawn through the device in use.

22 Claims, 26 Drawing Sheets

(51) Int. Cl.

| | |
|---|---|
| ***A24F 7/02*** | (2006.01) |
| ***A24F 13/02*** | (2006.01) |
| ***A24F 13/10*** | (2006.01) |
| ***A24D 3/04*** | (2006.01) |
| ***A24F 7/04*** | (2006.01) |

(52) U.S. Cl.
CPC ..... *A24F 7/04* (2013.01); *A24F 13/02* (2013.01); *A24F 13/10* (2013.01)

(56) References Cited

U.S. PATENT DOCUMENTS

| | | | | |
|---|---|---|---|---|
| 3,339,557 | A | 9/1967 | Karalus | |
| 3,468,316 | A | 9/1969 | Baum et al. | |
| 4,038,994 | A | 8/1977 | Aikman | |
| 4,227,540 | A | 10/1980 | Edison | |
| 4,478,228 | A | 10/1984 | Chister | |
| 4,484,590 | A | 11/1984 | Singh | |
| 4,559,955 | A | 12/1985 | Brockway et al. | |
| 4,637,407 | A | 1/1987 | Bonanno et al. | |
| 4,677,995 | A * | 7/1987 | Kallianos | A24D 3/041 131/335 |
| 4,848,375 | A | 7/1989 | Patron et al. | |
| 4,945,931 | A * | 8/1990 | Gori | A24F 47/008 131/194 |
| 4,991,605 | A | 2/1991 | Keritsis | |
| 6,336,896 | B1 | 1/2002 | Hsu | |
| 7,658,197 | B1 * | 2/2010 | Villagomez | A24F 3/02 131/184.1 |
| 2004/0237974 | A1 | 12/2004 | Min | |
| 2005/0126568 | A1 | 6/2005 | Davies | |
| 2006/0272659 | A1 | 12/2006 | Kobal et al. | |
| 2008/0053465 | A1 * | 3/2008 | Tarora | A24F 13/06 131/187 |
| 2013/0037042 | A1 * | 2/2013 | Hearn | A24F 47/002 131/329 |
| 2013/0333709 | A1 | 12/2013 | Shimizu | |
| 2016/0007648 | A1 | 1/2016 | Sutton et al. | |

FOREIGN PATENT DOCUMENTS

| | | | | |
|---|---|---|---|---|
| CN | 101141892 | | 3/2008 | |
| CN | 201108029 | | 9/2008 | |
| CN | 101277621 | | 10/2008 | |
| CN | 101951796 | | 1/2011 | |
| CN | 102258219 | A | 11/2011 | |
| DE | 3938634 | | 6/1990 | |
| DE | 19645563 | A1 | 5/1998 | |
| DE | 102005016415 | | 11/2006 | |
| EP | 1859694 | A1 | 11/2007 | |
| GB | 607728 | A * | 9/1948 | A24F 13/10 |
| GB | 2299012 | | 9/1996 | |
| JP | S64-009598 | | 1/1989 | |
| JP | H01-098470 | | 4/1989 | |
| JP | 2009-213428 | | 9/2009 | |
| JP | 2012075370 | | 4/2012 | |
| WO | WO02069745 | | 9/2002 | |
| WO | WO2004/089126 | | 10/2004 | |
| WO | 2006098171 | A1 | 9/2006 | |
| WO | 2007110650 | A1 | 10/2007 | |
| WO | WO2009022232 | | 2/2009 | |
| WO | WO2011095410 | | 8/2011 | |
| WO | 2012117578 | A1 | 9/2012 | |

OTHER PUBLICATIONS

International Preliminary Report on Patentability, dated Feb. 27, 2015, for International Application No. PCT/GB2014/050545.

Application and File History for PCT Patent Application No. PCT/GB2014/050544 (parent to U.S. Appl. No. 14/771,086) filed Feb. 24, 2014, inventors Sutton et al.

International Search Report and Written Opinion for International Application No. PCT/GB2014/050544 dated Sep. 22, 2014, 7 pages.

Japanese Office Action, Application No. 2015-559559, dated Nov. 29, 2016, 4 pages (8 pages with translation).

Chinese Office Action, Application No. 201480023874.7, dated Mar. 30, 2018, 11 pages (27 pages with translation).

Japanese Office Action, Application No. 2015-559560, dated Sep. 13, 2016, 4 pages.

Japanese Notice of Allowance, Application No. 2015-559560, dated Mar. 27, 2017.

Chinese Office Action, Application No. 201480023894.4, dated Dec. 8, 2016, 8 pages. (23 pages with translation).

Chinese Notification to Grant Patent Right for Invention, Application No.: 201480023894.4, dated Dec. 4, 2017.

* cited by examiner

INHALATION DEVICE AND INHALANT APPARATUS

This application is the National Stage of International Application No. PCT/GB2014/050545, filed Feb. 24, 2014, which in turn claims priority to and benefit of United Kingdom Patent Application No. GB1303433.5, filed Feb. 27, 2013. The entire contents of the aforementioned applications are herein expressly incorporated by reference.

FIELD

In this specification there is described a multi-component inhalant apparatus, including an inhalation device for use with an inhalant-generating component, and in which supplementary ventilation air flow and/or flavourant may be provided.

BACKGROUND

Inhalation devices are known and include a variety of configurations, including devices for producing a vapour for inhalation by a user such as electronic cigarettes, and aerosol generating devices which produce a vapour or aerosol for inhalation by a user by heating a source material. Also, cigarette holders are known which comprise a body configured to receive a cigarette and through which the cigarette may be smoked. Such devices may include one or more ventilation apertures to allow ambient air into the device to mix with the gas, vapour, aerosol or smoke stream drawn through the device.

SUMMARY

In this specification there are described embodiments of an inhalation device configured to hold an inhalant-generating component to generate an inhalant to be drawn through the device and inhaled by a user, comprising a body having a first open end configured to receive an inhalant-generating component and, a second open end in fluid communication with the first end through which a user may draw inhalant from the inhalant-generating component, wherein the body is configured to receive a flavour delivery component having an organoleptic material to selectively allow or prevent addition of an organoleptic additive into an inhalant stream drawn through the device, and wherein the device includes a ventilation control mechanism configured to selectively allow different amounts of ambient air into the body to mix with and dilute the inhalant stream as it is drawn through the device in use.

The ventilation control mechanism may be configurable between a closed position in which no ambient air is introduced into the inhalant stream from the inhalant-generating component as it is drawn through the smoking device, and a plurality of open positions in which different amounts of ambient air are introduced into the inhalant stream.

The second end of the body may be configured to receive the flavour delivery component.

In this specification there are also described embodiments of a flavour delivery component configured for connection to the body of an inhalation device, such as that described above, the flavour delivery component including an organoleptic material. The flavour delivery component may comprise a mouthpiece.

In this specification there are also described embodiments of an inhalation device as described above, having a flavour delivery mechanism comprising a flavour delivery component as described above, connected to the body of the inhalation device.

The flavour delivery component may be connected to the second end of the body

The flavour delivery mechanism may be switchable between a first position in which organoleptic additive is introduced into the inhalant stream, and a second position in which organoleptic additive is prevented from being introduced into the inhalant stream.

The inhalant stream may bypass the organoleptic material when the flavour delivery mechanism is in the second position.

The flavour delivery mechanism may comprise an actuator which is rotatable relative to the controller body. The flavour delivery component may comprise the actuator.

The flavour delivery component may be removeably attached to the body.

The ventilation control mechanism may be adjustable independently of the flavour control mechanism.

The inhalation device may further comprise a charcoal filter element disposed upstream of the flavour control mechanism.

One of the flavour delivery component and the controller body may include a recessed track and the other of the flavour delivery component and controller body may include a pin received in the track to retain the flavour delivery component on the controller body.

The track may include detents in which the pin can locate which correspond to the first and second positions of the flavour delivery component, to define stable rotational positions thereof.

The inhalation device may further comprise an ejection mechanism configured to eject the inhalant-generating component from the device.

The ejection mechanism may be actuated by a longitudinal force being exerted on an inhalant-generating component held in the device.

The ejection mechanism may comprise a spring to eject the inhalant-generating component from the device.

The inhalation device may comprise a smoking apparatus configured to hold a combustible tobacco rod or rod of other smokeable material, to be smoked through the device and subsequently removed from the device and discarded. The inhalant-generating component may comprise a combustible tobacco rod or a rod of smokeable material. The smoking device may further comprise a rod of smokeable material removeably received in the first end of the controller body.

The rod of smokeable material may be cylindrical and may comprises a first section of a first diameter and a second section of a second diameter smaller than the first diameter, wherein the second section may be received in the first end of the smoking device.

The rod of smokeable material may comprise an outer sleeve along part of its length which defines the first section of the first diameter and a step between the first and second sections.

Alternatively, the inhalation device may be configured to receive a vapour-generating component comprising tobacco and a heat generator for heating the tobacco to generate inhalant vapour.

Yet further, alternatively the inhalation device may be configured to receive a vapour-generating component comprising a reservoir of liquid and a heat generator for heating the liquid to generate inhalant vapour.

The inhalation devices described above may be formed integrally with an inhalant-generating component as described above, or may be configured to removeably receive an inhalant-generating component.

In this specification there are also described embodiments of a modular inhalant apparatus comprising a reusable holder for receiving replaceable inhalant-generating components, the holder comprising a body with a first open end, a mouthpiece removeably attached to the first open end, an inhalant-generating component removeably received in a second open end of the body, wherein the apparatus comprises a replaceable flavour additive element configurable to selectively introduce or prevent introduction of an organoleptic additive to an inhalant stream as it is drawn from the inhalant-generating component and out of the mouthpiece, wherein the mouthpiece comprises the replaceable flavour additive element.

BRIEF DESCRIPTION OF THE DRAWINGS

Embodiments of a smoking device will now be described, by way of example only, with reference to the accompanying drawings, in which.

DETAILED DESCRIPTION

Figure 1:
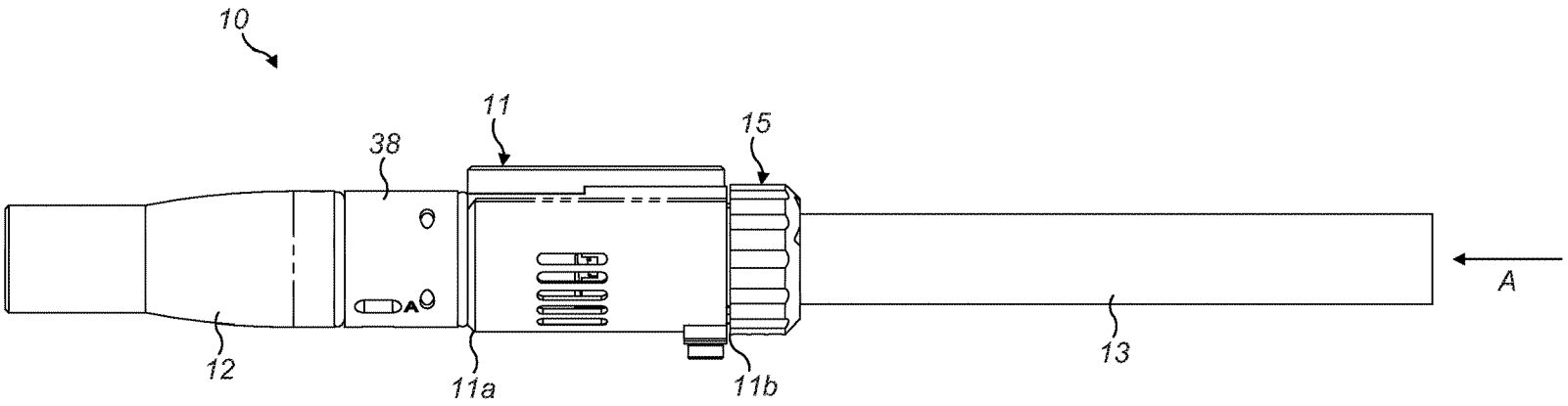
FIG. 1 shows a side view of an inhalation device of a first embodiment.

Referring to FIGS. 1-8, a first embodiment of an inhalation device which, in this first exemplary embodiment, comprises a smoking apparatus 10, comprises a controller body 11 and a mouthpiece 12. The controller body 11 comprises a first (mouth) end 11*a* and, a second (tobacco rod) end 11*b* opposite to the first end. The first and second ends are open and are in fluid communication with each other. A combustible tobacco rod 13 is receivable in an aperture in the second end 11*b* of the controller body 11.

In use, the tobacco rod 13 is inserted into the second end 11*b* of the controller body 11 and ignited. A user inhales through the mouthpiece 12 and smoke is drawn through the tobacco rod 13, through the controller body 11 and out of the mouthpiece 12 as the tobacco rod 13 is combusted. When the user has finished smoking, the remaining portion of the combusted tobacco rod 13 is discarded and a new tobacco rod 13 is inserted for each subsequent use of the apparatus 10.

The controller body 11 is a multi-use component of the apparatus 10, that is, it can be used for the smoking of multiple tobacco rods 13. The mouthpiece 12 is also a multi-use component although can be removed from the controller body 11 and replaced with a new mouthpiece 12 when required.

The controller body 11 includes an ejection mechanism configured to eject the spent tobacco rod. The ejection mechanism is actuated by a "stubbing" action, that is, by applying a force on the tobacco rod 13 in a longitudinal direction of the controller body 11 and tobacco rod, towards the mouthpiece 12, shown by arrow 'A' in FIG. 1.

The controller body 11 comprises a generally cylindrical housing 14 containing a ventilation control sleeve 15 rotatably mounted therein, and a collar 38. An ejection tube 16 is slidably mounted within the ventilation control sleeve 15. The cylindrical housing 14 comprises a first portion 14*a* at a tobacco rod end, and a second portion 14*b* of a smaller diameter than the first portion at a mouth end, extending from the first portion 14*a*. The first portion 14*a* transitions to the second portion 14*b* at an annular wall 17 which lies in a plane perpendicular to the central axis of the cylindrical housing 14. The collar 38 is attached to the second portion 14*b* of the cylindrical housing 14, and the mouthpiece 12 is attached to the collar 38.

A coil spring 18 is disposed within the cylindrical housing 14 and has a first end that abuts an inwardly-extending flange 32 of the ventilation control sleeve (described in more detail below) and an opposite end that abuts an end of the ejection tube 16. The spring 18 biases the ejection tube 16 in a direction away from the annular wall 17.

Figure 3:
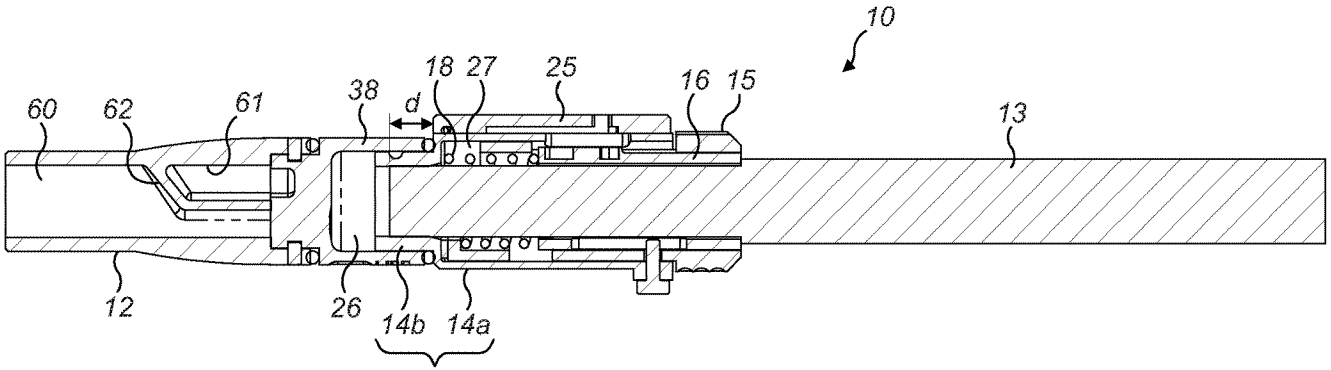
FIG. 3 shows a cross-section view along the line X-X of FIG. 2.
Figure 2:
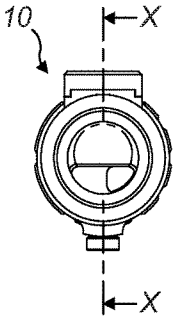
FIG. 2 shows an end view of the inhalation device of FIG. 1.
Figure 4:
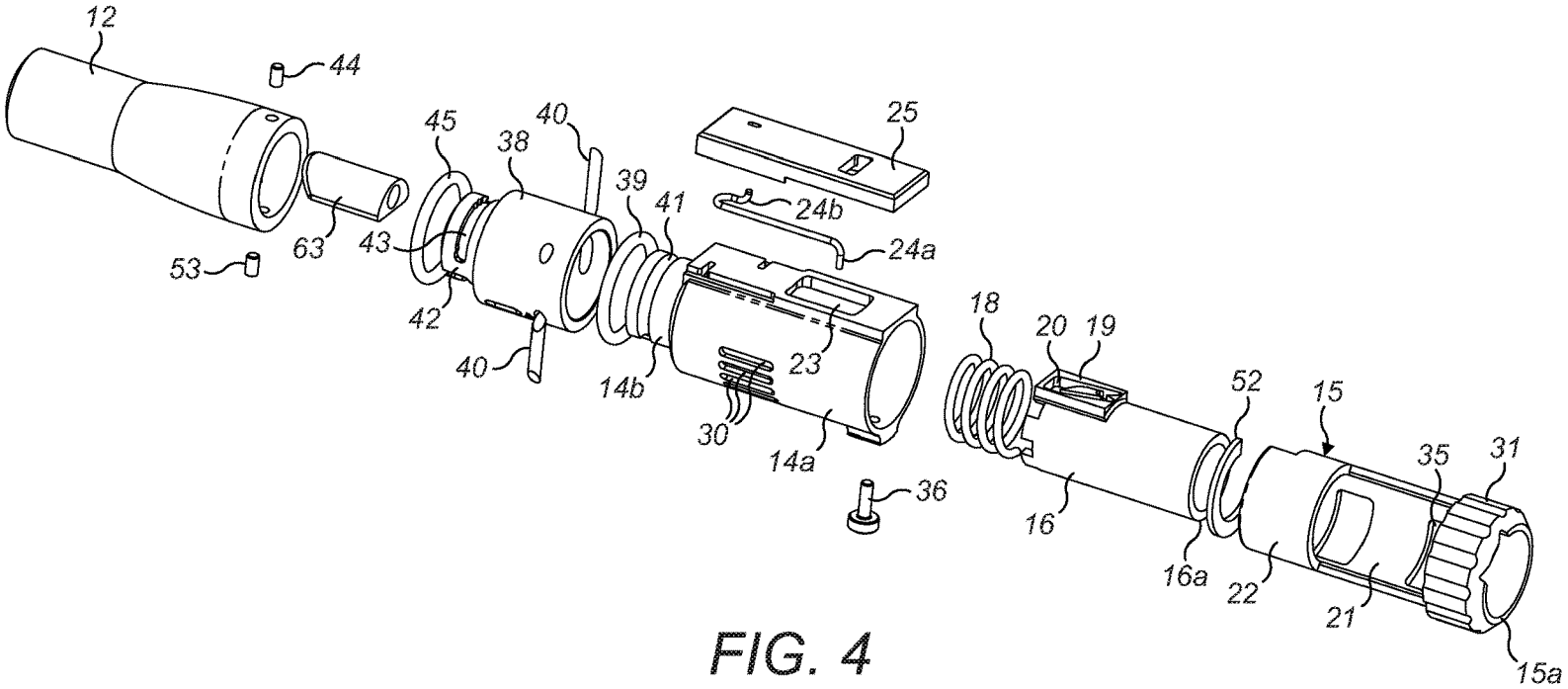
FIG. 4 shows an exploded perspective view of the inhalation device of FIG. 1.

The ejection tube 16 comprises a rectangular raised boss 19 on an outer surface thereof that has a recessed cam track 20 formed therein. The ventilation control sleeve 15 includes a cut out section 21 from its outer wall 22 to accommodate the projecting boss 19 of the ejection tube 16. The cut out section 21 is configured to allow the ejection tube 16 to slide within a predefined range of movement, limited by the ends of the boss 19 abutting the respective edge of the cut out section 21, and also to allow rotation of the ventilation control sleeve 15 within the cylindrical housing 14. The ejection tube 16 is moveable between a holding position, in which an end 16*a* of the ejection tube 16 lies flush with the end face 15*a* of the ventilation control sleeve 15 (as shown in FIGS. 1 and 3) and an ejection position in which the end 16*a* of the ejection tube 16 projects beyond the end face 15*a* of the ventilation control sleeve 15.

The cylindrical housing 14 includes a window 23 aligned with the boss 19 of the ejection tube 16. A resilient spring arm 24 is positioned on the outside of the cylindrical housing 14 and has a first end 24*a* bent at 90 degrees which extends through the window 23 and locates in the recessed cam track 20 of the boss 19 to act as a cam follower. The opposite end 24*b* of the spring arm 24 is fastened to a cover plate 25 which is secured to the cylindrical housing 14 to cover the window 23. The spring arm 24 is configured such that the cam follower 24*a* is moveable laterally with respect to the cylindrical housing 14 but is elastically biased back to a neutral position. The cam track 20 of the boss 19 comprises a closed loop within which the cam follower 24*a* travels to define the holding and ejection positions and the movement of the ejection tube 16 therebetween. In an embodiment in which the cut out section 21 in the ventilation control sleeve 15 is larger than required to limit longitudinal movement of the ejection tube 16, the first end 24*a* of the spring arm 24 located in the recessed cam track 20 of the boss 19 can act to limit the longitudinal movement of the ejection tube 16.

Figure 5:
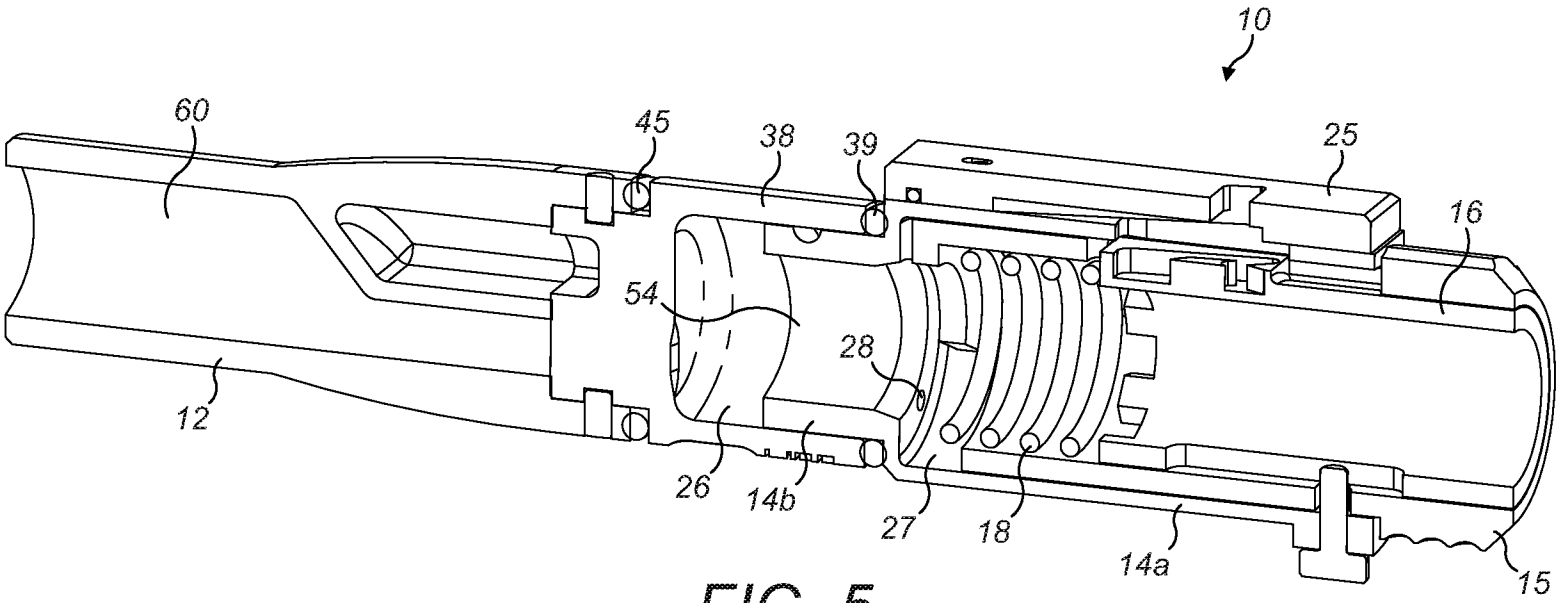
FIG. 5 shows a perspective cross-section view along the line X-X of FIG. 2 but with the tobacco rod removed.
Figure 6:
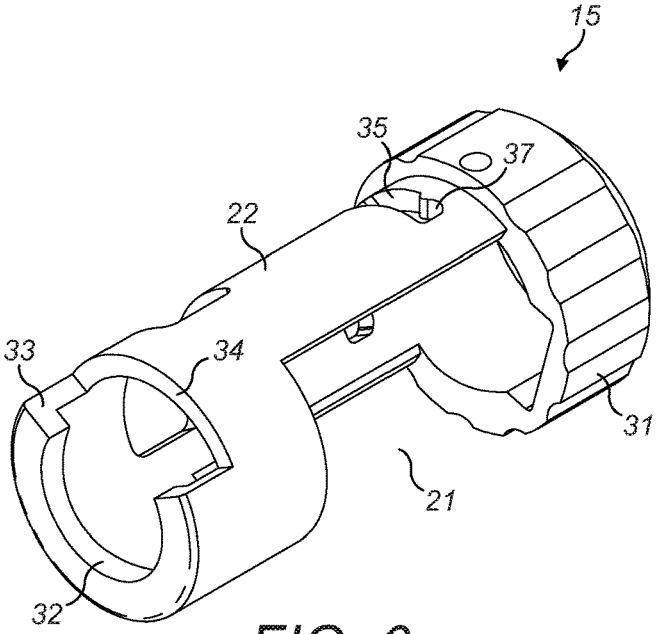
FIG. 6 shows a perspective view of the ventilation control sleeve of the inhalation device of FIG. 1.
Figure 7:
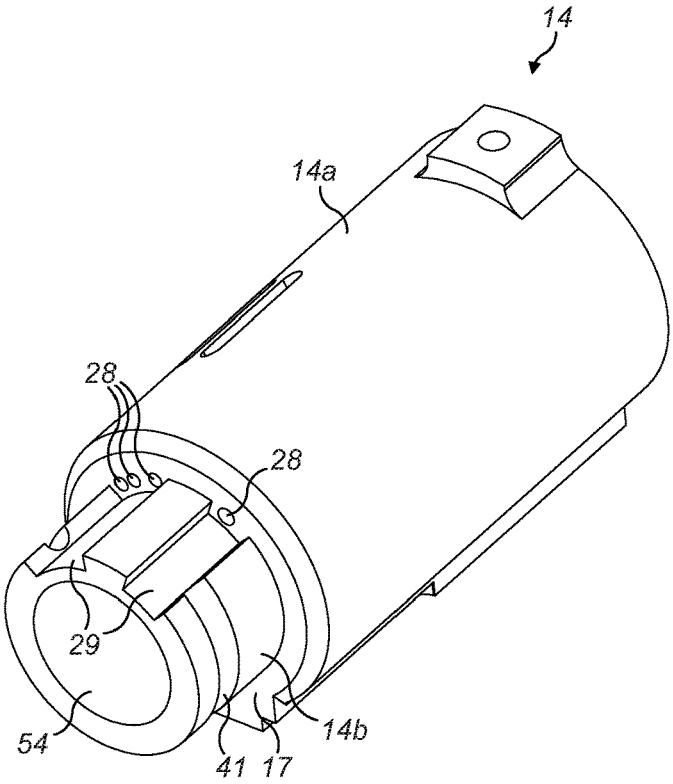
FIG. 7 shows a perspective view of the cylindrical housing of the inhalation device of FIG. 1.

The annular wall 17 of the cylindrical housing 14 includes a plurality of ventilation holes 28, as shown in FIGS. 5 and 7. Ventilation channels 29 are formed in the second portion 14*b* of the cylindrical housing 14 and extend from the ventilation holes 28 to the end of the second portion 14*b* of the cylindrical housing 14. The cylindrical housing 14 also includes a plurality of air inlet slots 30 formed through the outer wall of the first portion 14*a*, as shown in FIG. 3.

A space 27 is defined within the first portion 14*a* of the cylindrical housing 14 around the outside of the tobacco rod 13. This ventilation space 27 is open to ambient atmosphere via the air inlet slots 30, and the ventilation holes 28 in the annular wall 17 open to the ventilation space 27.

The ventilation control sleeve 15 includes a ridged grip 31 at one end thereof and an inwardly-extending flange 32 at an opposite end thereof. The flange 32 does not extend around the entire circumference of the opposite end of the ventilation control sleeve 15, but instead includes an open section 33 which is adjacent a corresponding recess 34 in the side wall 21 of the ventilation control sleeve 15. The flange 32 abuts against the annular wall 17 and is configured such that it may block one or more of the ventilation holes 28, or the ventilation control sleeve 15 may be rotated so that the open section 33 is aligned with the ventilation holes 28 so that they are open to the ventilation space 27. A gasket 52 (see FIG. 4) may be disposed between the flange 32 and the annular wall 17 to ensure a secure seal therebetween and to ensure effective blocking of the ventilation holes 28 when the ventilation control sleeve 15 is appropriately positioned. Although a gasket 52 is shown and described, this may be omitted so that the flange 32 seals directly against the annular wall 17, or other sealing means may be used, such as a washer, additional flange or sealant coating on the flange 32, to provide effective blocking of the ventilation holes 28.

The ventilation control sleeve 15 includes a slot 35 around a portion of the circumference of the side wall 21 adjacent the ridged grip 31 that receives the end of a locking post 36 though the wall of the cylindrical housing 14. The locking post 36 prevents the ventilation control sleeve 15 from sliding out of the cylindrical housing 14 but enables ventilation control sleeve 15 to rotate over a range of movement determined by the length of the slot 35. The slot includes detents 37 to define stable rotational positions of the ventilation control sleeve 15.

The collar 38 is a hollow cylindrical component secured around the second portion 14*b* of the cylindrical housing 14 with an o-ring seal 39 disposed between the collar 38 and outside of the annular wall 17 of the cylindrical housing 14. The collar 38 is secured in place by a pair of retaining pins 40 which locate in peripheral groove 41 in the second portion 14*b* of the cylindrical housing 14.

The end of the collar 38 remote from the cylindrical housing 14 includes a projecting portion 42 of reduced diameter with a shaped cam-groove 43 formed around a section of the perimeter surface thereof. The mouthpiece 12 is connected to the collar 38 around the projecting portion 42 by a cam pin 44 extending through the mouthpiece wall and locating in the cam-groove 43, and an assembly pin 53 extending through the mouthpiece wall and locating in a channel 33 on the projecting portion 29 separate to the cam groove 30. An o-ring 45 may optionally be disposed between the mouthpiece 12 and collar 38 to form an airtight seal therebetween.

Figure 11:
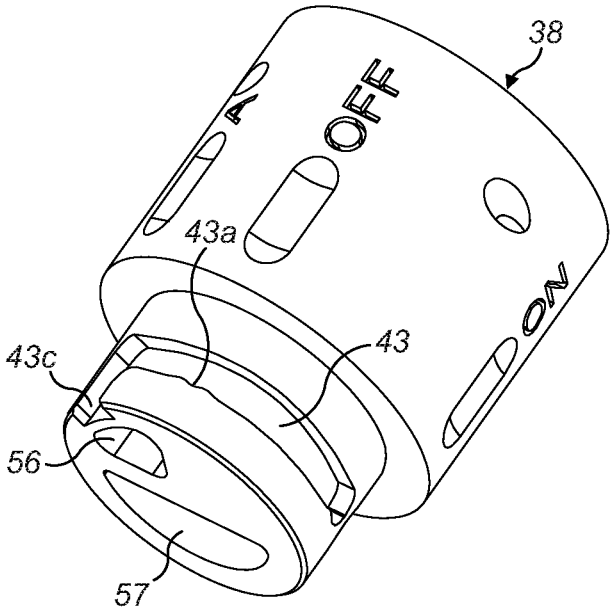
FIG. 11 shows a front perspective view of the collar of the inhalation device of FIG. 1.
Figure 12:
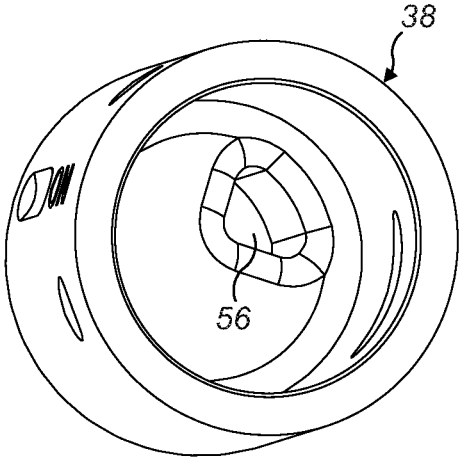
FIG. 12 shows a rear perspective view of the collar of FIG. 11.
Figure 15:
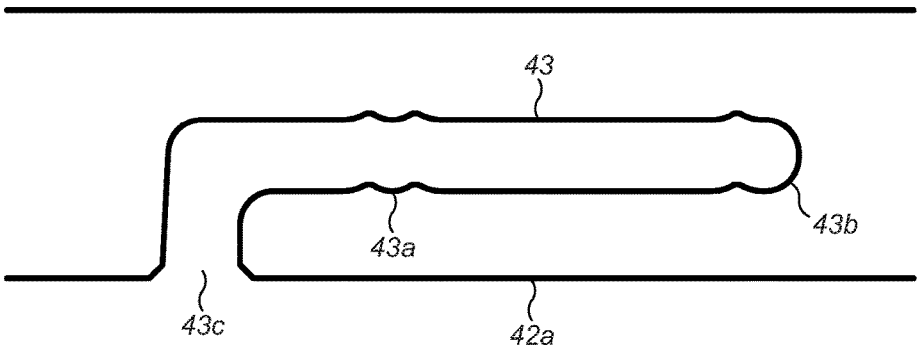
FIG. 15 shows a schematic two-dimensional view of the cam groove of the collar of the inhalation device of FIG. 1.
Figure 16A:
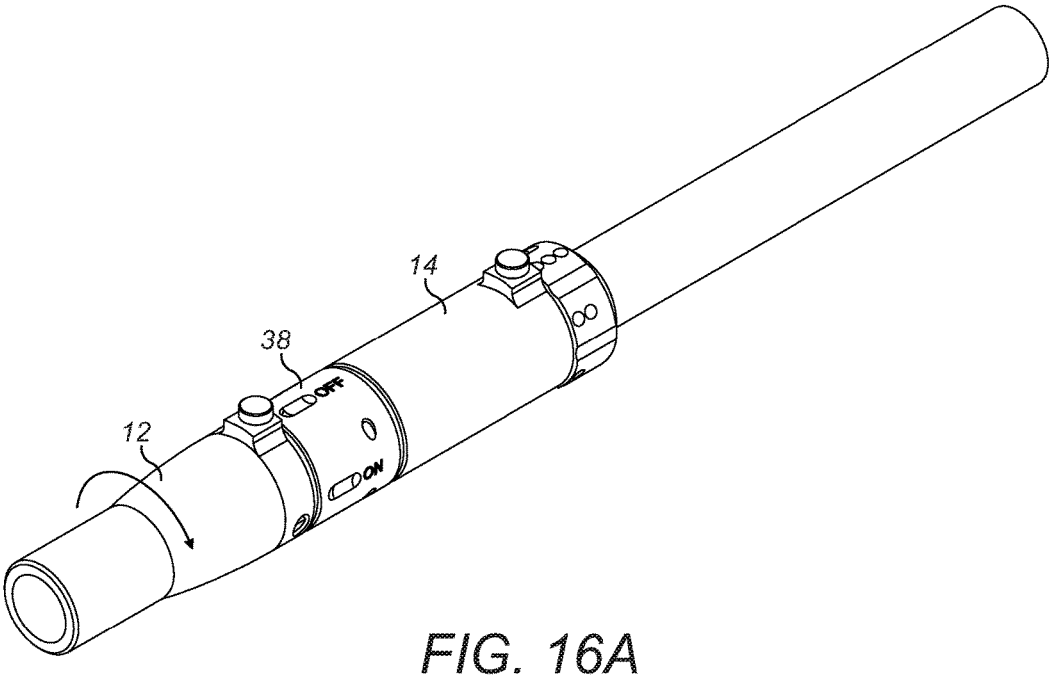
FIGS. 16A-16B show sequential perspective views of the smoking device of FIG. 1 with the mouthpiece being rotated between 'flavour off' and 'flavour on' positions.
Figure 16B:
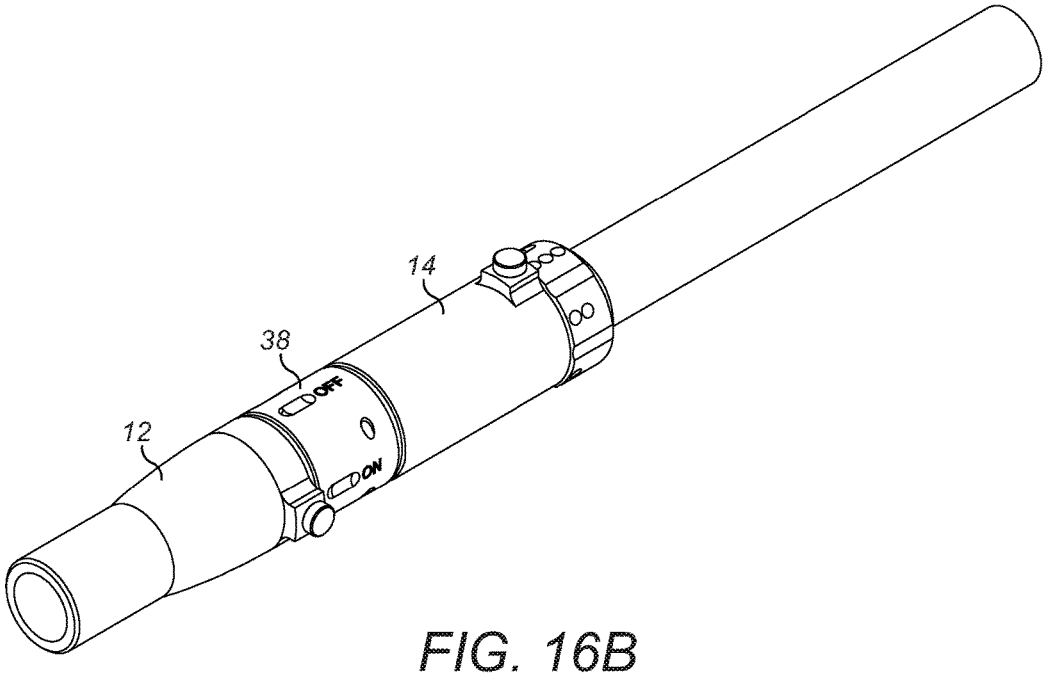

The mouthpiece 12 is rotatable relative to the collar 38, as shown in FIGS. 16A and 16B, between flavour "OFF" and "ON" positions. The extent of rotation is defined by the length of the cam groove 43 in which the cam pin 44 travels as the mouthpiece 12 is rotated. The cam groove 43 is shown in FIG. 11 and schematically in FIG. 15, and comprises an "OFF" detent 43*a* and an "ON" detent 43*b* which provide stable positions of the mouthpiece 12 relative to the collar 38 in the respective flavour ON/OFF positions. Each detent 43*a*, 43*b* is spaced slightly further from an end face 42*a* of the projecting portion 42 than the remainder of the cam groove 43 so that the mouthpiece 12 is pulled tighter against the collar 38 when the cam pin 44 is located in the detents 43*a*, 43*b* than when the cam pin 44 is located in the rest of the cam groove 43 when rotating between ON/OFF positions. This promotes achieving an improved secure seal between the mouthpiece 12 and collar 38 in the ON/OFF positions. The detents 43*a*, 43*b* also provide a tactile feedback to the user that the mouthpiece 12 is correctly located in the desired position. The cam groove 43 also includes an entrance portion 43*c* which extends to the adjacent end face 42*a* of the projecting portion 42 of the collar 38 to receive the end of the cam pin 44 when the mouthpiece 12 is attached to and removed from the collar 38.

The collar 38 is hollow to allow smoke to pass therethrough, and a path through the collar 38 exits through the end face 42*a* at a quadrant opening 56 at an upper portion thereof. A lower portion of the end face 42*a* includes a recess 57 which is semi-circular and separate from the path through the collar 38. The recess 57 is a blind cavity, that is, it is closed-bottomed and open only at the end face 42*a*.

Figure 9:
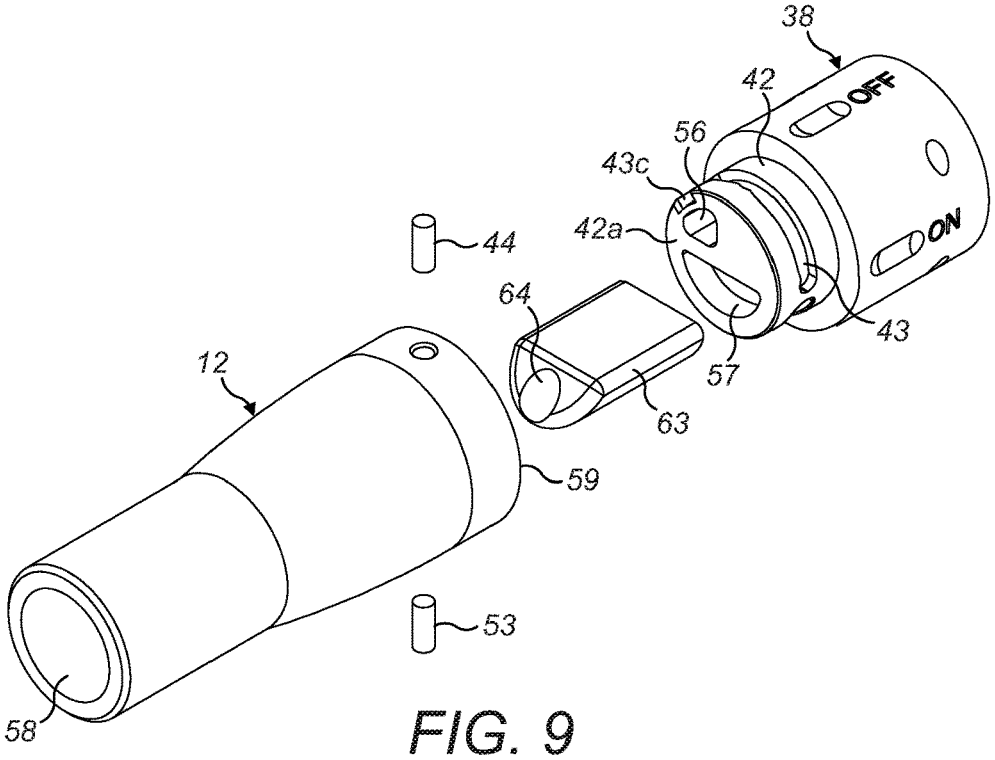
FIG. 9 shows an exploded perspective view of the mouthpiece and collar of the inhalation device of FIG. 1.
Figure 10:
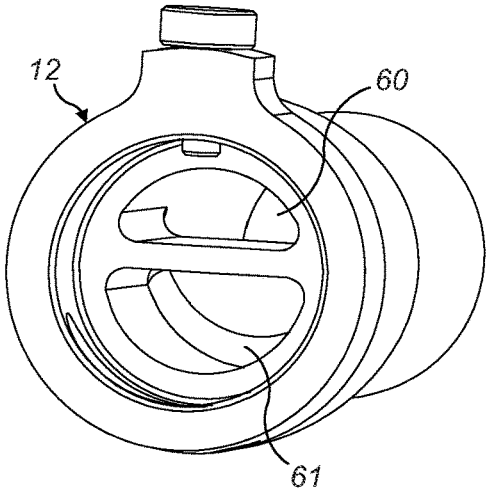
FIG. 10 shows a rear perspective view of the mouthpiece of the inhalation device of FIG. 1.

The mouthpiece 12 is shown in more detail in FIGS. 9 and 10, and includes a first open end 58 through which smoke is drawn by a user, and a second open end 59 which receives the projecting portion 42 of the collar 38. A passage 60 communicates the first and second open ends 58, 59. The passage 60 narrows from the first open end 58 to the second open end 59, such that the opening of the passage 60 at the second open end 59 is semi-circular. The second open end 59 of the mouthpiece 12 includes a recess 61 which is separate from the passage 60. The recess 61 is a blind cavity, that is, it includes an opening at one end only, the opposite end being closed by an end wall 62.

A body of organoleptic material 63 is disposed in the recess 61 to impart a flavour to smoke as the smoke stream passes across the surface area of the body 63. The body 63 includes a cavity 64 extending therethrough. The body 63 may comprise a material matrix containing a flavourant, for example, cellulose acetate impregnated with menthol flavourant. Alternatively, the body 63 may comprise a different solid material impregnated with flavourant or other organoleptic compound. The flavourant imparted may be by means of particulate material entrained in the smoke stream, or in gaseous form evaporated or otherwise leached from the organoleptic material 63.

A chamber 26 is defined within the collar 38 adjacent the end of the second portion 14*b* of the cylindrical housing 14, into which smoke flows when drawn through the tobacco rod 13. Furthermore, the ventilation channels 29 extending from the ventilation holes 28 open into the chamber 26. Therefore, in use, the chamber 26 acts as a mixing chamber for smoke drawn through the tobacco rod 13 and ventilation air introduced via the ventilation holes/channels 28/29.

Figure 17:
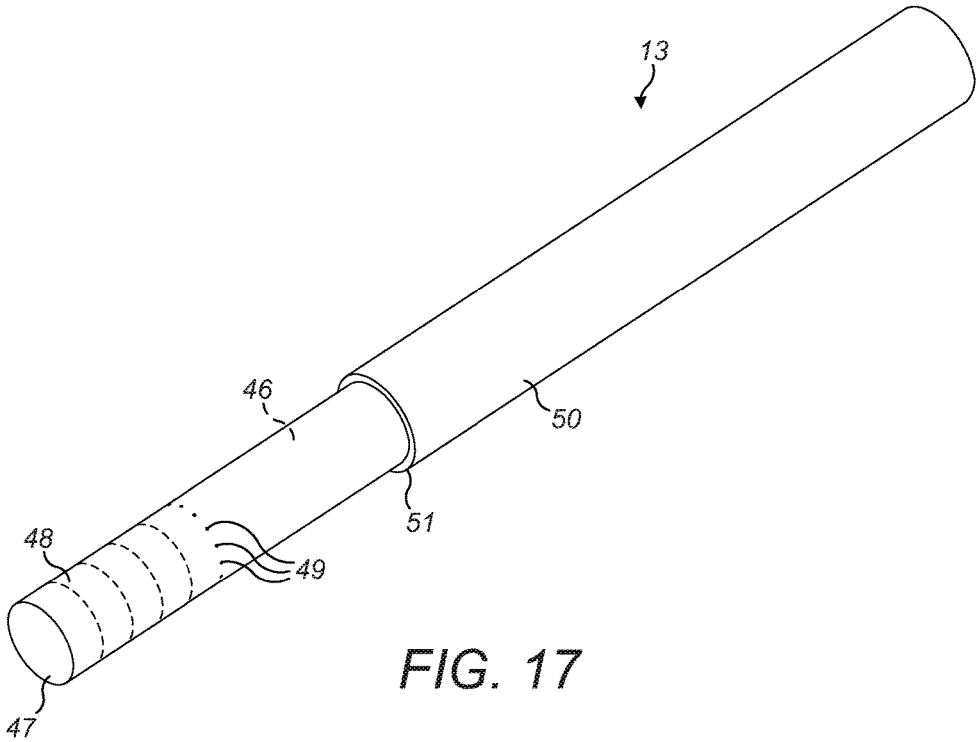
FIG. 17 shows a perspective view of a combustible tobacco rod for use with the inhalation device of FIG. 1.

The combustible tobacco rod 13 used with the smoking apparatus lo is shown in FIG. 17 and comprises a cylinder of smokeable material 46 such as tobacco and a plug of filtration material 47, contained in a wrapper 48. A plurality of ventilation holes 49 are formed through the outer surface of the wrapped cylinder at the portion that surrounds the filter material 47, to allow flow of ventilation air to pass from the ventilation space 27 into the filter 47 through the wrapper 48 and mix with smoke drawn therethrough in use. The tobacco rod 13 includes an outer sleeve 50 which extends over part of the length of the wrapped tobacco cylinder and stops short of the filter end to provide a perimeter step 51.

In use, with the ejection tube 16 in the extended, ejection position, a user inserts a tobacco rod 13 into the controller body 11 so that the filter end extends through the ventilation control sleeve 15 and ejection tube 16. As the tobacco rod 13 is inserted into the controller body 11, the step 51 abuts the end of the ejection tube 16 and pushes it into the ventilation control sleeve 15 against the force of the spring 18 and the ejection mechanism retains the ejection tube 16 in the holding position. The filter end of the tobacco rod 13 makes an interference friction fit within the bore 54 of the second portion 14*b* of the cylindrical housing 14 and is thereby held in place. This friction fit creates a seal to substantially prevent any airflow between the surface of the tobacco rod 13 and the inner surface of the bore 54 of the second portion 14*b* of the cylindrical housing 14. The distance over which the filter end of the tobacco rod 13 is received within the second portion 14*b* of the cylindrical housing 14 is shown as dimension 'd' in FIG. 3.

Figure 8A:
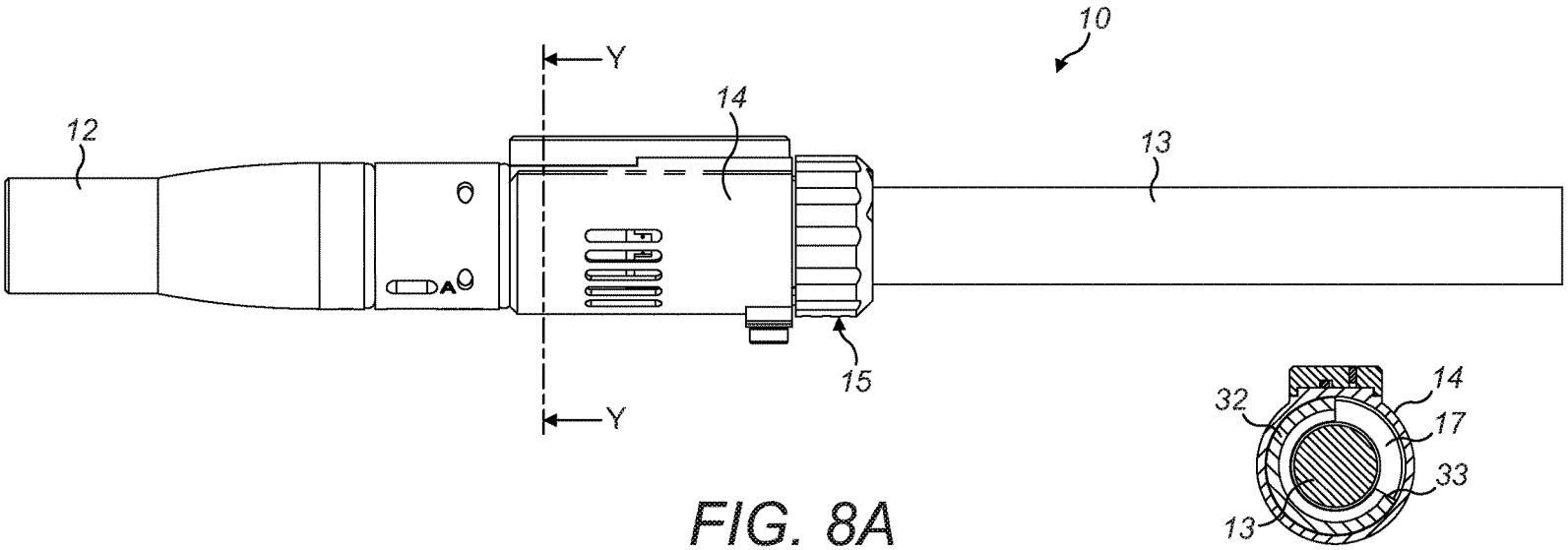
FIG. 8A shows a side view and a cross-sectional view along the line Y-Y, of the inhalation device of FIG. 1 in a first ventilation level configuration.
Figure 8B:
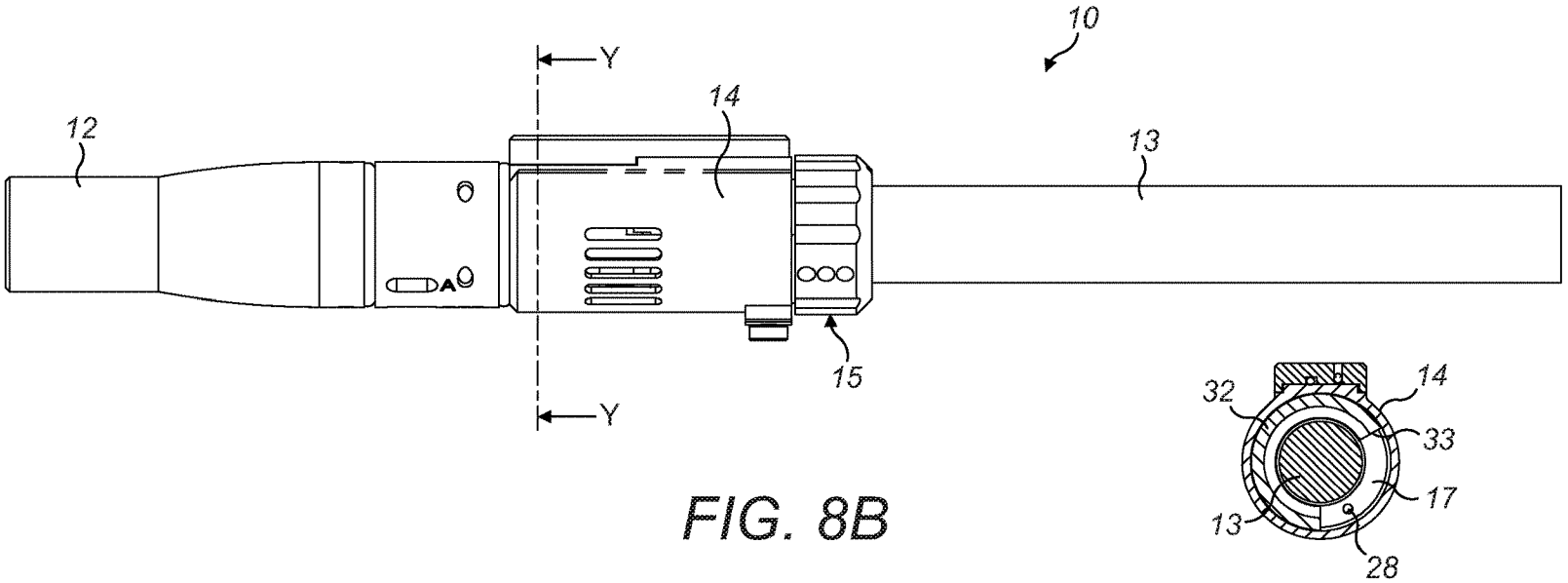
FIG. 8B shows a side view and a cross-sectional view along the line Y-Y of the inhalation device of FIG. 1 in a second ventilation level configuration.
Figure 8C:
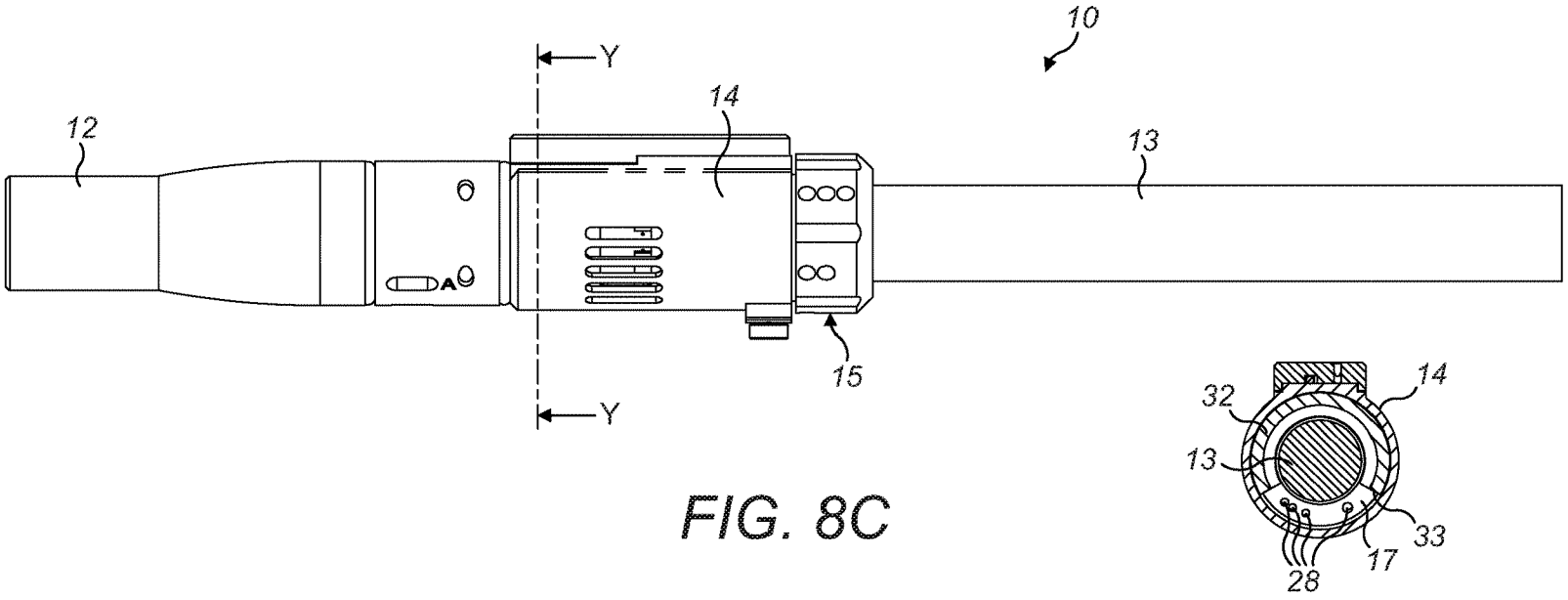
FIG. 8C shows a side view and a cross-sectional view along the line Y-Y, of the inhalation device of FIG. 1 in a third ventilation level configuration.

The user is able to vary the amount of ventilation air that is mixed with the smoke stream during smoking of the tobacco rod 13. This variable ventilation air is referred to as bypass ventilation since it bypasses the tobacco rod 13 and is introduced into the smoke stream downstream of the point where the smoke exits the filter end of the tobacco rod 13. Referring to FIGS. 8A to 8C, the ventilation control sleeve 15 may be moved between three different ventilation positions. These three positions correspond to detents 37 in the slot 35 to define stable rotational positions of the ventilation control sleeve 15. FIG. 8A shows the ventilation control sleeve 15 in a first position, in which the flange 32 covers all ventilation holes 28 in the annular wall 17 and so no bypass ventilation air is permitted to pass therethrough.

FIG. 8B shows the ventilation control sleeve 15 in a second position, in which the open section 33 of the ventilation control sleeve is aligned with one of the ventilation holes 28 in the annular wall 17, the other ventilation holes 28 remaining blocked by the flange 32. Therefore, when user draws on the mouthpiece and a negative pressure is created in the mixing chamber 26, as well as smoke being drawn through the tobacco rod 13, air is drawn from the ventilation space 27, through the one exposed ventilation hole 28 and corresponding ventilation channel 29 and into the mixing chamber 26 where it mixes with the smoke drawn through the tobacco rod 13. This additional ventilation air dilutes the smoke stream and thus provides a different smoking sensory experience to the user for each inhalation compared to the situation described above where no bypass ventilation is permitted.

FIG. 8C shows the ventilation control sleeve 15 in a third position, in which the open section 33 of the ventilation control sleeve is aligned with a plurality of the ventilation holes 28 in the annular wall 17. When user draws on the mouthpiece, air is drawn from the ventilation space 27, through the plurality of exposed ventilation holes 28 and corresponding ventilation channels 29 and into the mixing chamber 26 where it mixes with the smoke drawn through the tobacco rod 13. This increased flow of ventilation air over the situation described above and shown in FIG. 8B, results in a greater dilution of the smoke stream and thus provides a yet further different smoking sensory experience to the user for each inhalation.

It will be appreciated that the above-described variable ventilation control is separate to the filter ventilation provided by the ventilation holes 49 formed in the filter end of the tobacco rod 13. Also, although only three separate ventilation positions are shown and described, the first embodiment is not intended to be limited to such a configuration and other numbers of ventilation positions may be provided. Furthermore, the bypass ventilation may be continually variable instead of having discrete ventilation settings. For example, an arcuate slot may be provided in the annular wall 17 instead of discrete ventilation apertures 28, the slot being exposed or occluded by rotation of the ventilation control sleeve 15.

In use, the mouthpiece 12 is pushed fully onto the collar 38 and the cam pin 44 enters the entrance portion 43*c* of the cam groove 43. The mouthpiece 12 is then rotated until the cam pin 44 locates in the OFF detent 43*a* (see FIG. 16A).

When the smoking device 10 is in use, a user has the option of whether or not flavourant is added to the smoke stream passing through the device 10. When the mouthpiece 12 is in the OFF position, the quadrant opening 56 in the collar 38 is aligned with the semi-circular open end of the passage 60 at the second open end 59 of the mouthpiece 12 to define a first smoke flow path through the smoking device 10 in which the smoke steam passes straight from the collar 38 through the passage 60 in the mouthpiece 12 and out of the first open end 58 without encountering the body of flavourant material 63.

Figure 13:
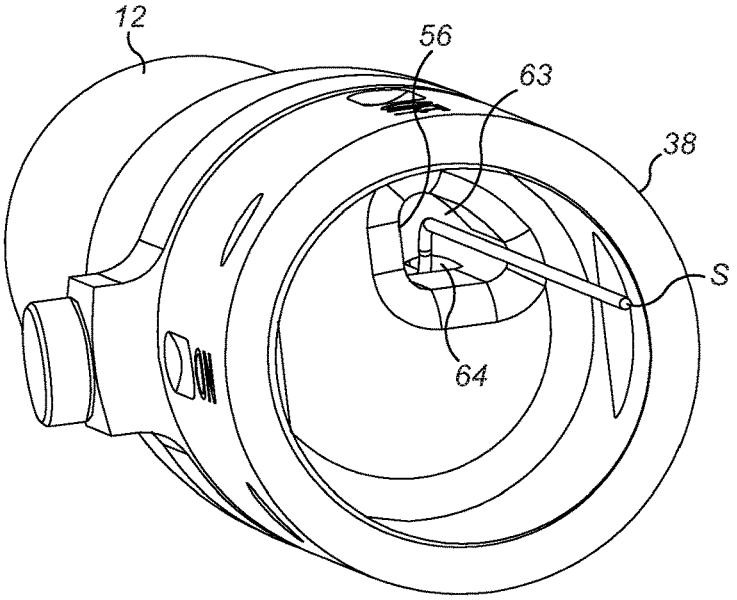
FIG. 13 shows a rear perspective view of the collar and mouthpiece of the inhalation device of FIG. 1 in the 'flavour on' position illustrating the inhalant flow path therethrough.
Figure 14:
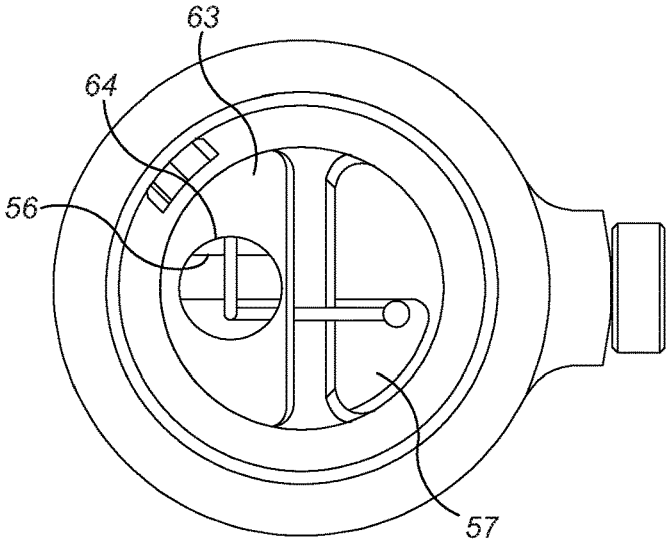
FIG. 14 shows a front perspective view of the collar and mouthpiece of FIG. 13 in the 'flavour on' position illustrating the inhalant flow path therethrough, with the mouthpiece shown as transparent for ease of illustration.

If a user wishes to experience a flavoured smoke, the mouthpiece is rotated to the ON position (see FIG. 1613). The quadrant opening 56 in the collar 38 then partially overlaps the cavity 64 in the body of flavourant 63 (see FIG. 13). In addition, the semi-circular recess 57 in the collar 38 also partially overlaps the cavity 64 in the body of flavourant material 63 (see FIG. 14), and partially overlaps the semi-circular end of the passage 60 in the second open end 59 of the mouthpiece 12, (see FIG. 14). When a user draws on the mouthpiece 12, smoke is drawn through a second smoke flow path through the smoking device 10, illustrated by arrow S in FIGS. 13 and 14, which travels through the quadrant opening 56 into the cavity 64 in the organoleptic body 63, within which the smoke swirls and picks up flavourant as it sweeps over the surface of the body 63. The smoke stream S exits the cavity 64 into the semi-circular recess 57 in the collar 38 and passes from the semi-circular recess 57 into the passage 60 and out of the mouthpiece 12 through the first open end 58.

The organoleptic body 63 may provide desirable flavour delivery for smoking of a predetermined number of tobacco rods 13, after which it may be depleted and require replacement. This may be achieved by removing the mouthpiece 12 and organoleptic body 63 and replacement with a new mouthpiece 12 having a fresh organoleptic body 63 therein. Alternatively, the organoleptic body 63 may be removable from the mouthpiece 12 and the user may replace the depleted organoleptic body 63 with a fresh one into the same mouthpiece 12. In the latter embodiment, the organoleptic body 63 may be provided within a sleeve or other outer casing (not shown) to facilitate removal from and replacement into the mouthpiece 12. In the former embodiment, the organoleptic body 63 may be formed with, or set into, the recess 61 in the mouthpiece 12 as a manufacturing step, and the replacement mouthpiece 12 may be provided with a sealing cover over the opening of the recess 61 to prevent escape of any organoleptic material before first use, such as any volatile and/or aromatic compounds. Such a cover could comprise a foil adhered over the opening which a user would remove prior to connecting the new mouthpiece 12 to the collar 38. In either case, the replaceable component of either the organoleptic body 63 or mouthpiece 12 could be provided in multiple refill packs supplied separately to the controller body 11 of the smoking device 10, for example, multi-blister packs in which each replacement component is sealed within its own pocket.

The detents 43*a*, 43*b* in the cam groove 43 are configured such that there is an interference fit between the mouthpiece 12 and collar 38 when the mouthpiece 12 is in the ON and OFF positions. When in the OFF position, this ensures an airtight seal between the recess 61 in the mouthpiece 12 and the end face 42*a* of the projecting portion 42 of the collar 38, which ensures that none of the organoleptic compounds escape, such as volatile and/or aromatic compounds When the user has finished smoking, the tobacco rod 13 can be extinguished by stubbing the end which causes the ejection tube 16 to be pushed inwards against the force of the spring 18 and the cam follower 24*a*/cam track 20 co-operate to move the ejection tube 16 into the ejection position and, as the ejection tube 16 abuts against the step 51 of the tobacco rod 13, the tobacco rod 13 is pushed out of frictional engagement with the bore 54 of the second portion 14*b* of the cylindrical housing 14 and so the remaining stub of the tobacco rod 13 is released from the controller body 11. The spring 18 can also provide an ejection force on the tobacco rod 13 to ensure it is ejected from the controller body 11. However, once the tobacco rod 13 has been pushed free from frictional engagement with the bore 54 of the cylindrical housing 14, the tobacco rod 13 is free to drop out of the controller body 11 under gravity.

The friction fit of the end of the tobacco rod 13 in the cylindrical housing 14 can be provided by the bore 54 of the second portion 14*b* of the cylindrical housing 14 being of a smaller diameter than the diameter of the end of the tobacco rod 13. For example, the bore 54 of the second portion 14*b* of the cylindrical housing 14 may be 5.3 mm in diameter and the diameter of the end of the tobacco rod 13 may be 5.4 mm. Also, to effectively retain and then release the tobacco rod 13 from the controller body 11, the axial distance over which the tip of the tobacco rod 13 is held in second portion 14*b* of the cylindrical housing 14 (shown as dimension "d" in FIG. 3) must be less than the travel of the ejection tube 16 between its holding and release positions. For example, distance d may be 3 mm and the ejection tube 16 travel between holding and release positions may be 4 mm.

In one embodiment, the filter end of the tobacco rod 13 includes a large number of ventilation holes 49 around the filter end, which render the tobacco rod un-smokeable on its own as a normal cigarette, as the excessive filter ventilation prevents sufficient air being drawn through the length of the tobacco rod for any appreciable degree of smoke to be drawn through the tobacco rod. However, when the tobacco rod 13 is inserted in the smoking device 10, a large number of the ventilation holes 49 (over the length 'd' of the tobacco rod 13) are blocked by virtue of the interference fit of the tobacco rod 13 within the second portion 14*b* of the cylindrical housing 14. This permits more air to be drawn along the length of the tobacco rod 13 when the user inhales and provide an acceptable smoke stream. Although not necessarily shown to scale in the figures, the length 'd' could be increased to cover the entirety of the filter portion, and possibly part of the tobacco portion, of the tobacco rod 13, so that all or many of the tobacco rod ventilation apertures 49 are covered when the tobacco rod is received in the bore 54 of the controller body 11, to further ensure the tobacco rod 13 would not be smokeable as a conventional cigarette without the rest of the smoking apparatus.

Figure 18:
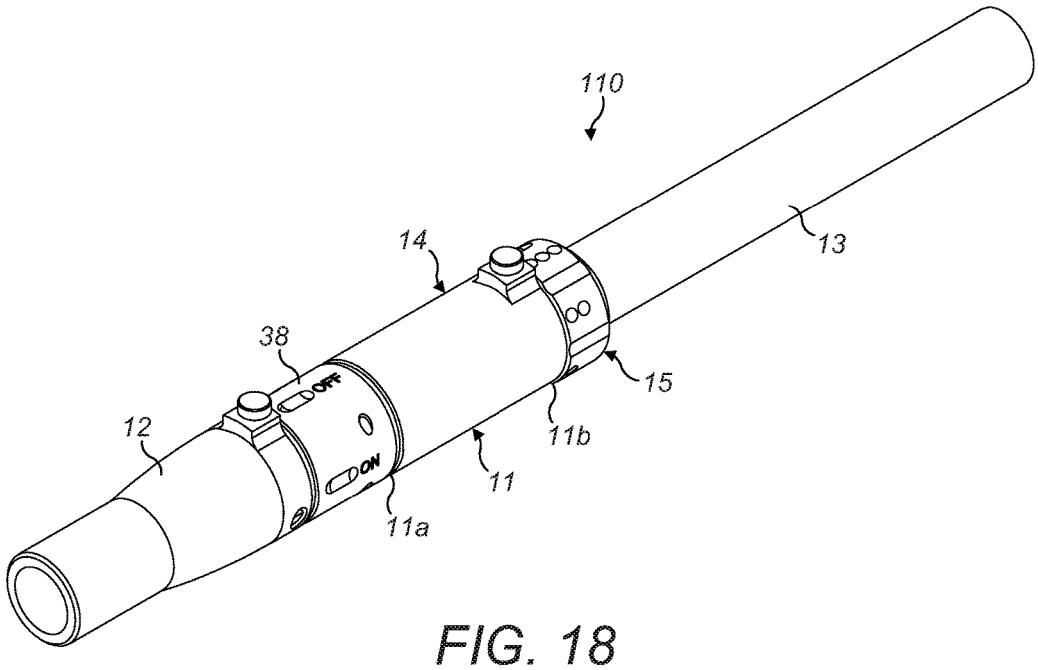
FIG. 18 shows a perspective view of an inhalation device of a second embodiment.
Figure 19:
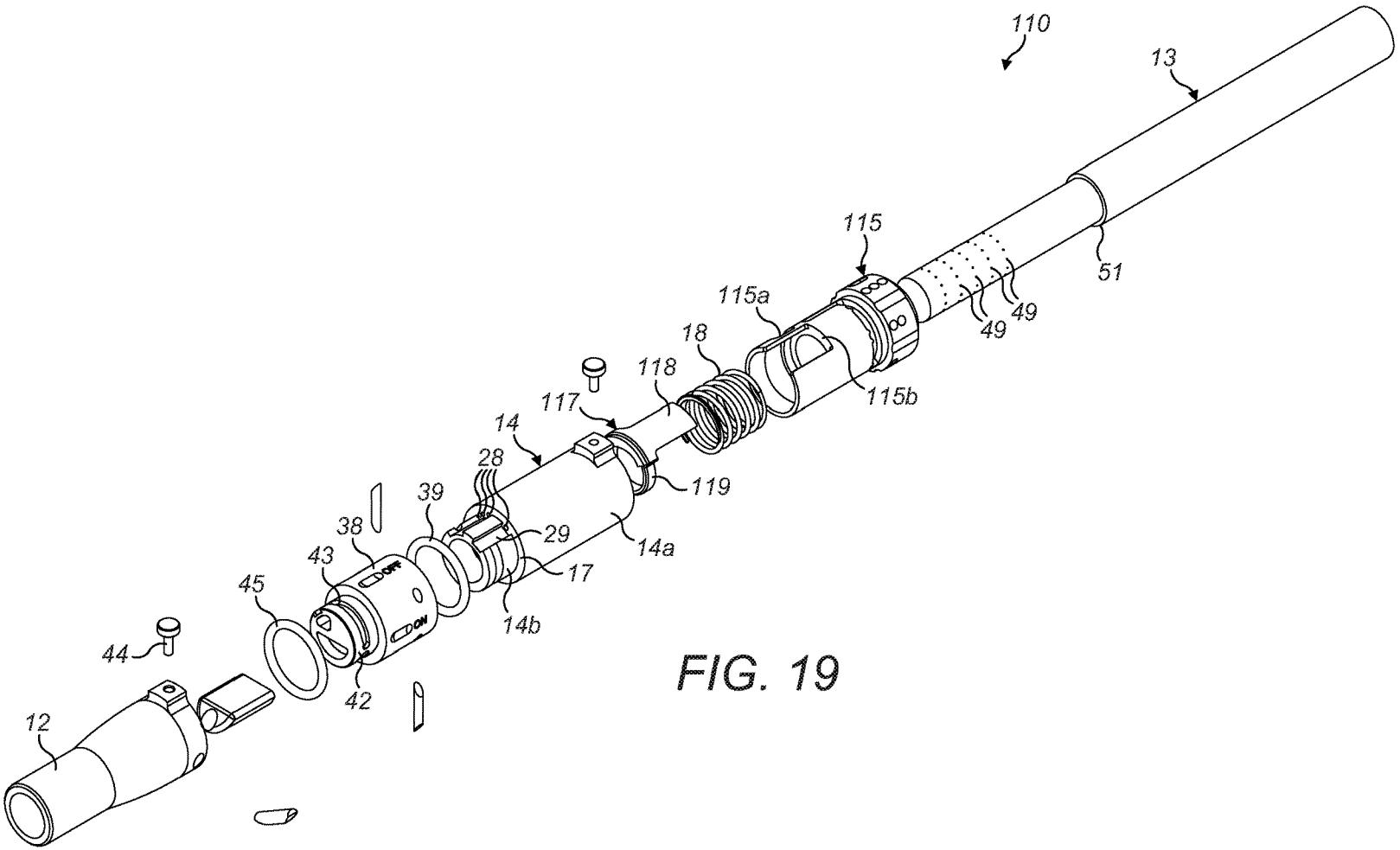
FIG. 19 shows an exploded view of the inhalation device of FIG. 18.

A smoking device 110 of a second embodiment is shown in FIGS. 18 and 19, and is largely the same as the first embodiment described above. As such, like features retain the same reference numerals and will not be described in detail again. One difference in the second embodiment is the configuration of the ventilation control sleeve 115. As shown in detail in FIG. 19, a ventilation control sleeve 115 of the second embodiment is not formed integrally with an inward flange 32, as with the ventilation control sleeve 15 of the first embodiment. The ventilation control sleeve 115 of the second embodiment comprises a hollow cylindrical body with a slot 115*a* formed in the side wall thereof.

A control ring 117 is rotatably mounted within the first portion 14*a* of the housing 14 and includes a plate 118 extending in an axial direction from a section of the perimeter of the control ring 117. The plate 118 is received within the slot 115*a* in the ventilation control sleeve 115 such that rotation of the ventilation control sleeve 115 causes the control ring 117 to rotate. The control ring 117 abuts against the inside of the annular wall 17 of the housing 14, but includes a section of reduced thickness 119 around a portion of the circumference thereof which is spaced from the annular wall 17.

The coil spring 18 is disposed within the cylindrical housing 14 between the control ring 117 and an inner rim 115*b* of the ventilation control sleeve 115. The spring 18 biases the control ring 117 against the annular wall 17 of the housing 14 and thereby improves the seal that the control ring 117 makes over the ventilation holes 28 in the annular wall 17.

As with the first embodiment, the ventilation control sleeve 115 can be adjusted to control an amount of ambient air that is drawn into the smoking device 10 to mix with the smoke stream as a user draws on the mouthpiece 12. In a first position of the ventilation control sleeve 115, the control ring 117 covers and blocks all of the ventilation holes 28 and so air within the ventilation space 27 is prevented from passing though the annular wall 17 and mixing with the smoke stream. The spring 18 biasing the control ring 117 into contact with the annular wall 17 ensures the seal is satisfactory.

Rotation of the ventilation control sleeve 115 to a second position moves the plate 118 and control ring 117 such that the section of reduced thickness 119 aligns with one of the ventilation holes 28 to provide a gap between the ventilation hole 28 and the control ring 117. Air within the ventilation space 27 is then able to pass though the annular wall 17 via the one exposed ventilation hole 28, pass along the corresponding ventilation channel 29, and mix with the smoke stream within the mixing chamber 26, to provide a first degree of smoke ventilation and dilution.

Further rotation of the ventilation control sleeve 115 to a third position moves the plate 118 and control ring 117 such that the section of reduced thickness 119 aligns with more of the ventilation holes 28 to provide a gap between the additional ventilation holes 28 and the control ring 117. Air from the ventilation space 27 is then able to pass though the annular wall 17 via the plurality of exposed ventilation holes 28, pass along the corresponding ventilation channels 29, and mix with the smoke stream within the mixing chamber 26, providing an increased level of smoke ventilation and dilution.

As with the first embodiment, the degree of external ventilation air that is introduced into the smoke stream is variable, thereby varying sensory intensity of the smoking experience. Also as with the first embodiment, although only three separate ventilation positions are shown and described, the second embodiment is not intended to be limited to such a configuration and other numbers of ventilation positions may be provided, or the bypass ventilation may be continually variable be provision of an arcuate slot instead of discrete ventilation apertures 28, as described above.

Referring now to FIGS. 20-23, a flavourant delivery and control mechanism 211 of a smoking device (not shown) of a third embodiment is shown. Such a mechanism can be incorporated into the collar 38 of the previously-described embodiments, and coupled to a mouthpiece 12 of a different configuration, not having recess 61 but simply being a tubular element. The remaining features of the smoking devices 10, no of the first and second embodiments remain unchanged and so detailed description will not be repeated.

The control mechanism 211 comprises a casing 212 having an inlet 213 in communication with an outlet 214 via a central chamber 215. The outlet 214 includes a plurality of blocking portions 216 arranged around the central axis of the outlet 214 which define a plurality of passages 217 therebetween. In the embodiment shown, there are three blocking portions 216 defining three passages 217, each shaped as a sector of the circular outlet. However, this arrangement is exemplary only and other numbers of passages/blocking portions may alternatively be provided.

Figure 20:
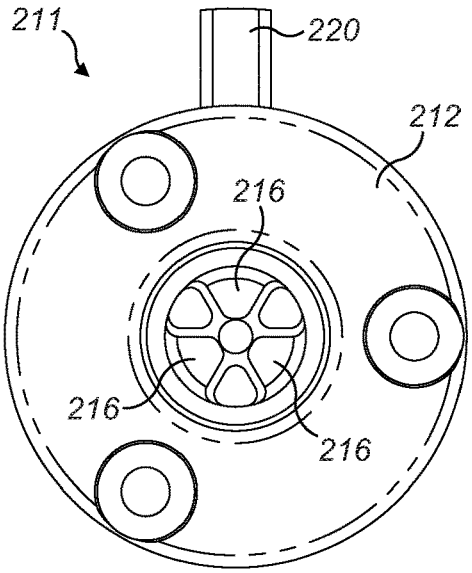
FIG. 20 shows an end view of a control mechanism of an inhalation device of a third embodiment in a 'flavour off' position.
Figure 21:
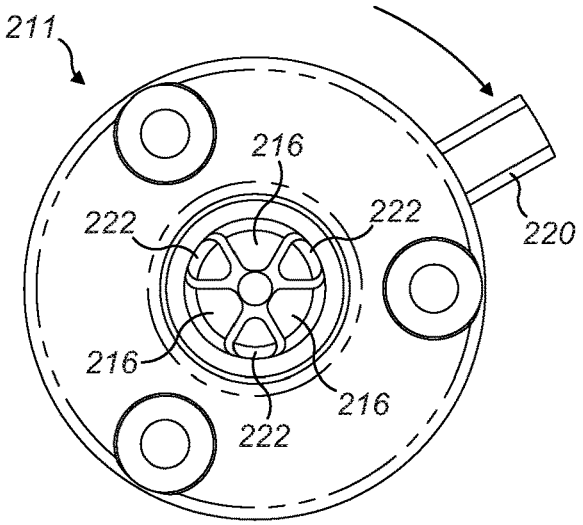
FIG. 21 shows an end view of the control mechanism of FIG. 20 in a 'flavour on' position.
Figure 22:
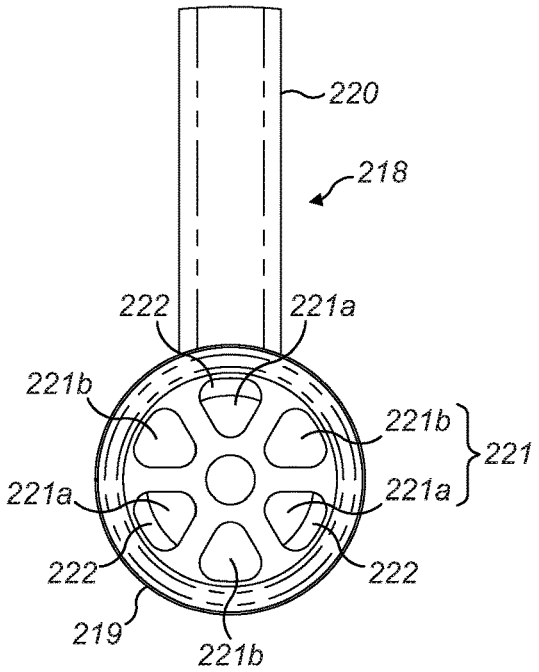
FIG. 22 shows an end view of a component of the control mechanism of FIGS. 20 and 21.
Figure 23:
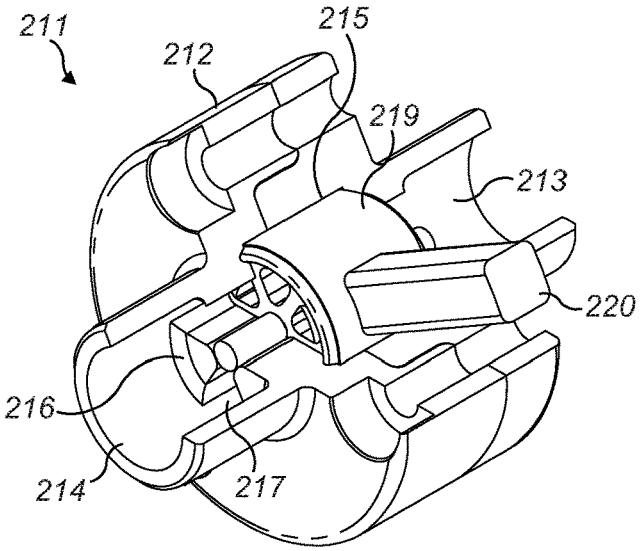
FIG. 23 shows a partial cut-away perspective view of the control mechanism of FIG. 21.

An actuator 218 is disposed in the casing 212 and has a cylindrical barrel portion 219 with a lever 220 extending therefrom. The lever extends through a slot (not shown) in the casing 212. The actuator 218 is rotatable within the casing 212 by movement of the lever 220 along the slot. The barrel 219 includes a plurality of sector-shaped passages 221 shaped corresponding to the blocking portions 216 and passages 217 in the outlet 214. The actuator 218 shown in FIGS. 20-23 includes six passages 221 although alternative embodiments may have more or less, depending on the configuration of the outlet 214. Alternating passages 221*a* of the actuator 218 include an organoleptic material 222 on an inside surface thereof, the remaining passages 221*b* do not have any such material. When the lever 220 is in an "OFF" position as shown in FIG. 20, the passages 221*a* with the organoleptic material coating are aligned with the blocking portions 216 and the passages 221*b* without the organoleptic material coating are aligned with the passages 217 in the outlet 214. Therefore, the only fluid path through the control mechanism from the inlet 213 to the outlet 214 is through the passages 221*b* without the organoleptic material coating. Conversely, when the lever 220 is in an "ON" position as shown in FIG. 21, the passages 221*a* with the organoleptic material coating are aligned with the passages 217 in the outlet 214 and the passages 221*b* without the organoleptic material coating are aligned with the blocking portions 216. Therefore, in the ON position, the only fluid path through the control mechanism from the inlet 213 to the outlet 214 is through the passages 221*a* with the organoleptic material coating.

In use, a user of the smoking device 210 can select between unflavoured smoke or flavoured smoke by moving the lever 220 between the OFF and ON positions. In the OFF position, the smoke stream passes through the passages 221*b* of the barrel 219 without encountering the organoleptic material. However, in the ON position, the smoke stream passes through the passages 221*a* of the barrel 219 which include the organoleptic material coating and so a flavourant is picked up by the smoke steam as it passes over the organoleptic material 222.

The twist flavour control mechanism 211 of the third embodiment may be replaced after a predetermined number of smokes of tobacco rods 13 or when the flavour delivery reduces. Replacement may occur by replacement of the collar 38 on the housing 14. In an alternative configuration of the smoking device, the control mechanism 211 may be provided on the mouthpiece instead of the collar, and so replacement of the flavour control mechanism may be effected by replacement of the mouthpiece as described previously. In such an alternative embodiment, the connector would not need to have the flow path shaped as a quadrant 56 as described above, and could simply comprise a central circular aperture.

Figure 24:
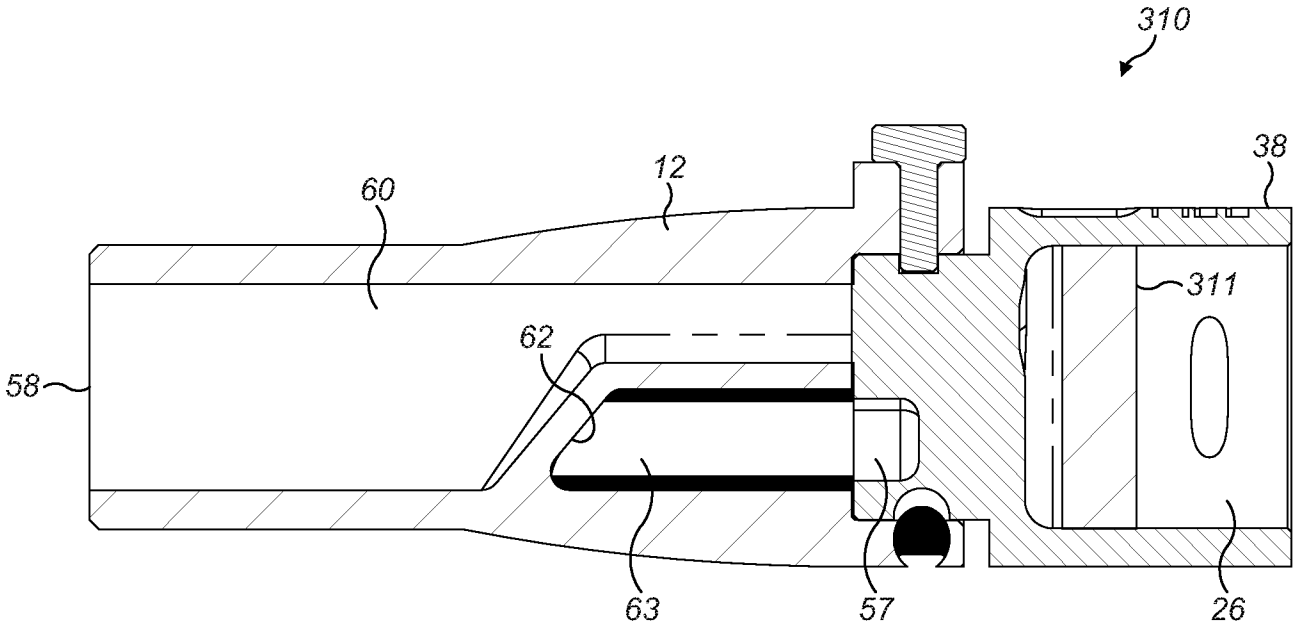
FIG. 24 shows a cross-sectional view of a mouthpiece and collar of a fourth embodiment.
Figure 25:
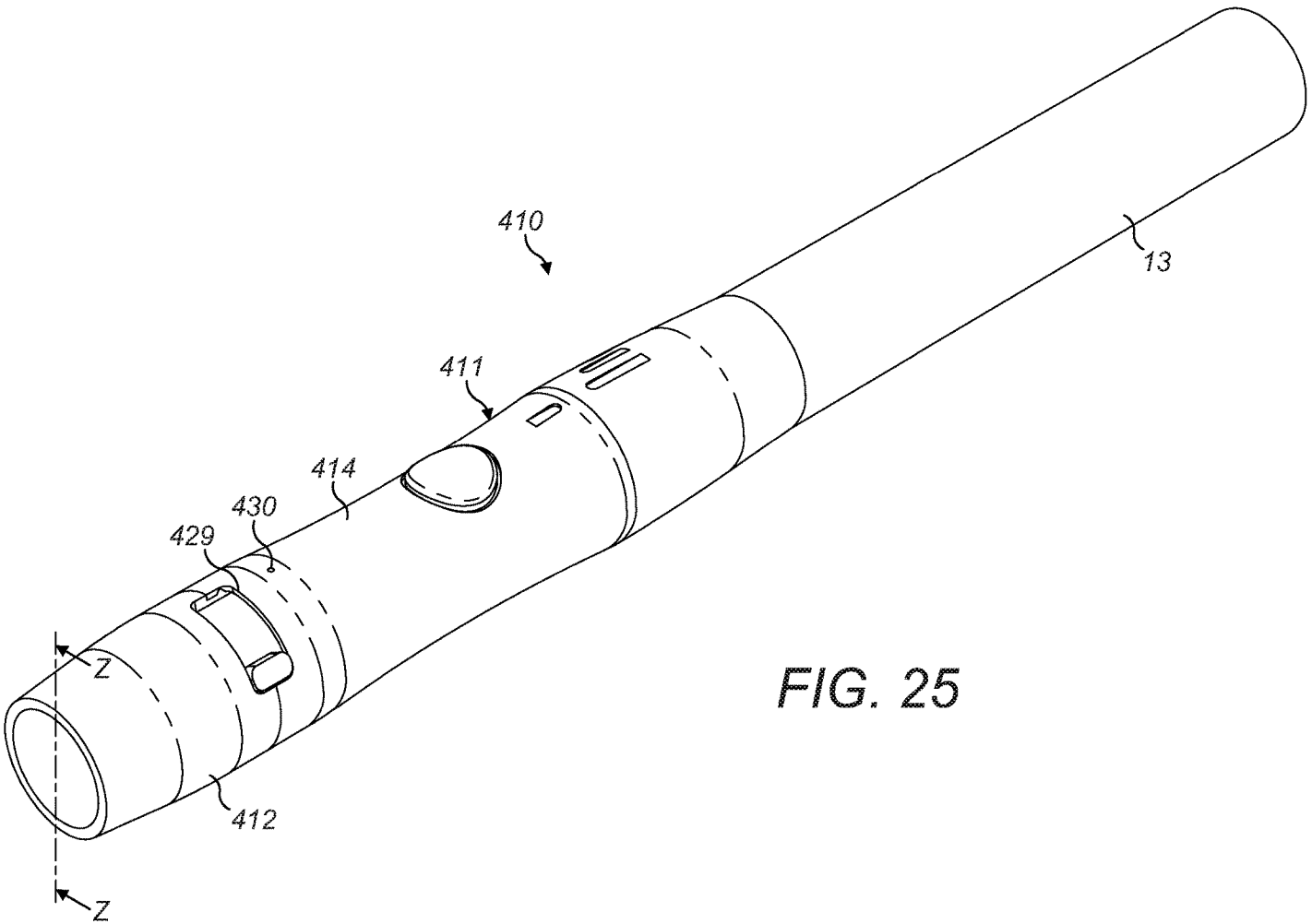
FIG. 25 shows a perspective view of an inhalation device of a fifth embodiment.

A mouthpiece 12 and collar 38 of a smoking device 310 of a fourth embodiment is shown in FIG. 24 and is similar to the mouthpiece 12 and smoking device 10 of the first embodiment, and like features retain the same reference numerals. One difference between the first and fourth embodiments is that the collar 38 of the fourth embodiment includes an additional filter element 311 in the form of a pad containing carbon-based material disposed in the mixing chamber 26 of the main body of the collar 38 between the entrance to the quadrant opening 56 and the end of the second portion 14*b* of the housing 14. The smoking device 310 of the fourth embodiment is used in the same manner as the first embodiment described above, although the smoke stream passes through the filter element 311 as it travels from the housing 14 into the mouthpiece 12. The carbon material in the filter element 311 filters out further constituents of the smoke stream before it reaches the mouthpiece 12. The technical benefit described above of the mouthpiece making an airtight seal against the collar 38 when in the flavour OFF position is again important so that the filter element 311 and the organoleptic body 63 are sealed from each other, in order to prevent any of the organoleptic material or volatile/aromatic components therefrom being absorbed by the carbon and therefore effectively wasted, reducing the life of the organoleptic body and/or reducing the effectiveness of the carbon-based filter element 311.

FIGS. 25-28 show a smoking device 410 of a fifth embodiment comprising a controller body 411 configured to receive a combustible tobacco rod 13 as described previously. The controller body 411 comprises a housing 414 and a mouthpiece 412 attached to an end thereof opposite the tobacco rod 13 end. The housing 414 contains a holding tube 416 which is slidable within the housing 414 and is configured to receive the end of a tobacco rod 13. The holding tube 416 includes a pawl 417 which is receivable in an aperture 418 in the housing 414. A push button 419 is provided on the housing over the aperture 418 to push the pawl 417 out of engagement with the edge of the aperture 418 to allow the holding tube 416 to slide within the housing 414. A spring 420 is disposed within the housing against a first end of the holding tube 416 and biases the holding tube 416 in a direction out of the housing 414. The pawl 417 is configured to retain the holding tube 416 in a retracted position within the housing against the force of the spring 420.

Figure 26:
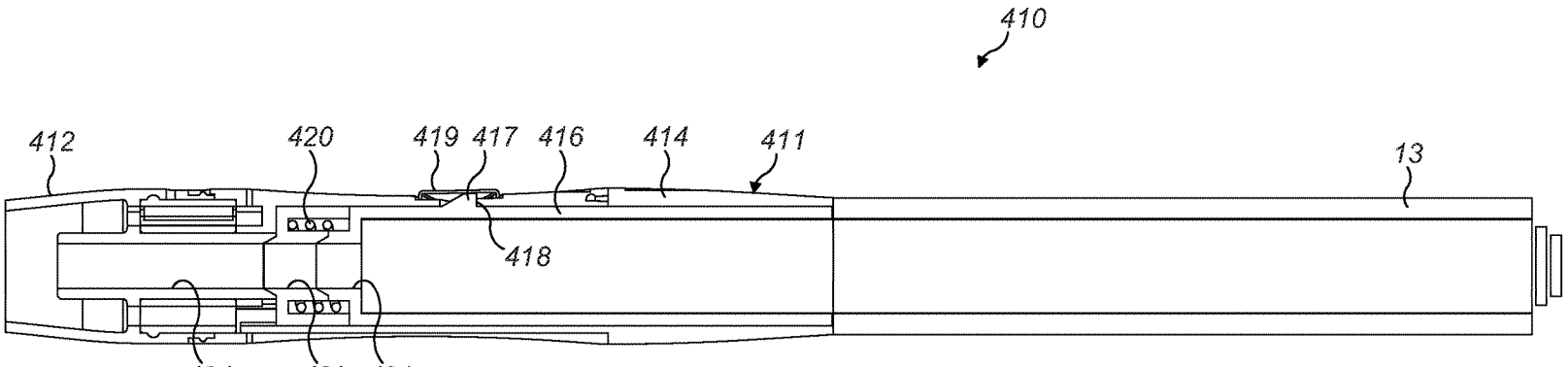
FIG. 26 shows a cross-sectional side view of the inhalation device of FIG. 25 along the line Z-Z.

A duct 421 extends from the first end of the holding tube 416 and couples to a duct 422 in the housing 414 when the holding tube is in the retracted position (see FIG. 26).

A flavour control cartridge 423 is provided within the mouthpiece 412 and the end of the housing 414, and comprises a central conduit 424 and a rotatable collar 425 around the outside of the conduit 424. The conduit 424 is fluidly coupled to the duct 422 in the housing 414 and thereby to the duct 421 in the holding tube 416. The collar 425 includes a plurality of passages 426 extending in an axial direction through the collar 425. A blocking plate 427 is provided around a portion of the outer perimeter of the conduit 424 and is configured to block the flow path though one of the passages 426 when it is aligned with the blocking plate 427.

An actuator button 428 projects from the outer surface of the collar 425 through a slot 429 in the side wall of the mouthpiece 412 such that the collar 425 can be rotated within the mouthpiece 412 between a first position and a second position by sliding the actuator button 428 along the slot 429. An outer wall of the mouthpiece 412 includes a ventilation hole 430 through which ambient air can pass into the area of the mouthpiece 412 behind the collar 425 of the flavour control cartridge 423 and around the outside of the conduit 424.

Figure 27:
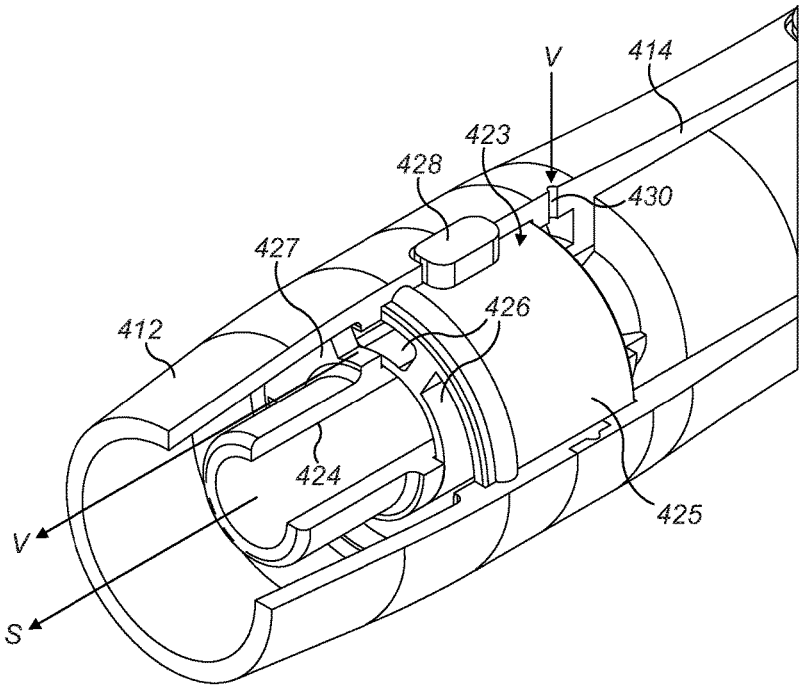
FIG. 27 shows a cut-away view of a portion of the inhalation device of FIG. 25 in a first position.
Figure 28:
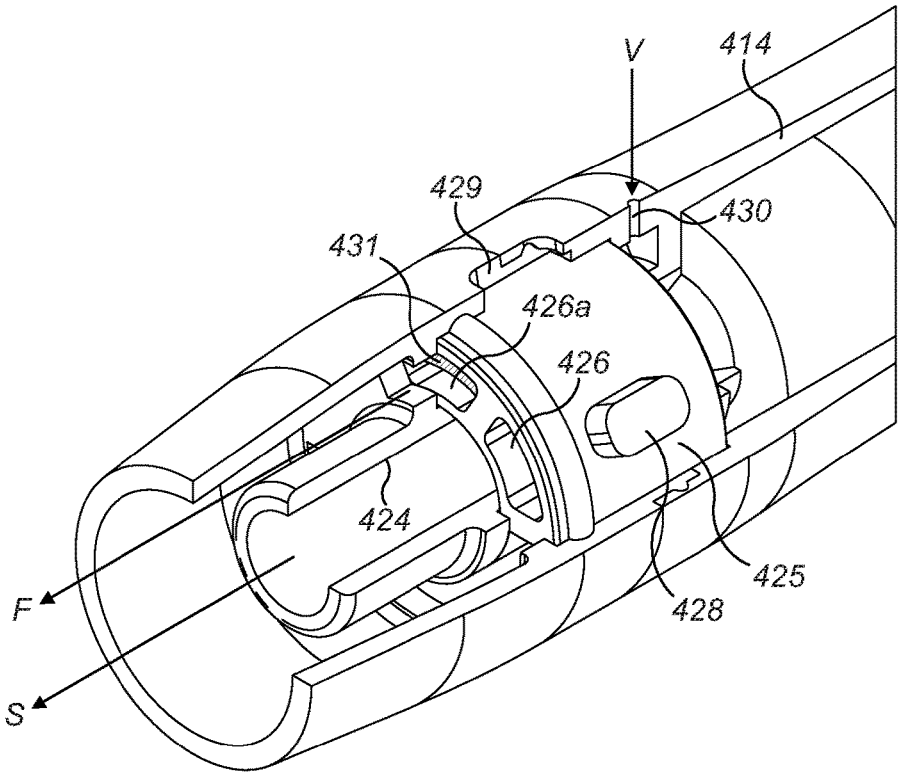
FIG. 28 shows a cut-away view of a portion of the inhalation device of FIG. 25 in a second position.

An inside wall of one of the passages 426*a* includes a coating of an organoleptic material 431, which may comprise flavourant compound, such that as air flows through the coated passage 426*a*, flavourant is imparted to the airflow as it sweeps over the organoleptic material 431. When the collar 425 is in the first position as shown in FIG. 27, the coated passage 426*a* with the organoleptic material 431 is located behind the blocking plate 427 and so airflow through the coated passage 426*a* is prevented. When the collar 425 is in the second position as shown in FIG. 28, the coated passage 426*a* is rotated away from the blocking plate 427 such that air may flow therethrough.

If a user uses the smoking device 410 to smoke a tobacco rod 13 with the collar 425 in the first position, when the user draws on the mouthpiece 412, smoke is drawn through the tobacco rod 13, through the duct 421 in the holding tube 416, through the duct 422 in the housing 414 and through the conduit 424 in the mouthpiece 412, as shown by arrow S in FIG. 27. Simultaneously, ambient air is drawn through the ventilation hole 430, though the passages 426 in the collar 425 and into the mouthpiece 412, as shown by arrow V in FIG. 27, where the ventilation air V mixes with the smoke stream S. As the coated passage 426*a* is aligned with the blocking plate 427, the ventilation airflow cannot pass therethrough and so no flavourant is imparted to the ventilation airflow. If, however, the collar 425 is moved to the second position, smoke is drawn into the mouthpiece 412 as described above, shown by arrow S in FIG. 28, but the ambient air drawn through the ventilation hole 430 is able to pass through the coated passage 426*a* since it has moved out of alignment with the blocking plate 427, and so the ventilation airflow V passes through the coated passage 426*a* and flavourant is imparted to the ventilation airflow as it sweeps over the organoleptic material 431, shown by arrow F in FIG. 28. Thereafter, the flavoured airflow F and smoke stream S mix in the mouthpiece 412.

The configuration of the smoking device 410 of the fifth embodiment is such that the smoke stream S and the ventilation airflow V, F are kept separate and only mix in the final portion of the mouthpiece 412 just prior to delivery to the mouth. Furthermore, it is only the ventilation air V, which bypasses the smoke stream S, that encounters the organoleptic material 431, and so the various control surfaces of the ventilation and flavour control mechanism do not encounter the smoke stream S. This arrangement prevents build up of deposits from the smoke stream on the ventilation/flavour control surfaces, with the inherent hygiene benefits and improved mechanism longevity.

Although the smoking device 410 of the fifth embodiment is described as having one coated passage 426*a* in the collar 425, variations to this configuration are intended, and the collar 425 may comprise a plurality of coated passages 426*a*. In such a variation, the flavour control cartridge 423 would include a corresponding plurality of blocking plates 427 such that all coated passages 426*a* are blocked in the collar's first position and are exposed for ventilation airflow to pass therethrough in the collar's second position. Such a configuration may be similar to the flavour control mechanism 211 of the third embodiment shown in FIGS. 20-23.

It is intended in an alternative variation of the smoking device 410 of the fifth embodiment that a mechanism may be included to selectively open or close the ventilation hole 430 such that a user may select no ventilation air to be mixed with the smoke stream, as well as selecting whether the ventilation air is flavoured or not.

The above-described embodiments comprise inhalation devices comprising smoking devices in which the inhalant comprises smoke generated from a combustible rod of smokeable material inserted into the body of the device. However, the present invention is not intended to be limited to smoking devices and may include other types of inhalation devices such as vapour-generating devices, such as electronic cigarettes, or other devices which produce an inhalant such as a gas, vapour or aerosol for inhalation by a user. Such devices may heat tobacco by a heat source without combustion of the tobacco, to cause a vapour to be produced from the tobacco for inhalation by a user. Such heat source may comprise an electrical heating element or heat produced by alternative means. Alternatively, such devices may heat liquid held in a reservoir, such as a nicotine solution, to produce an inhalant in the form of a gas or vapour.

Figure 29:
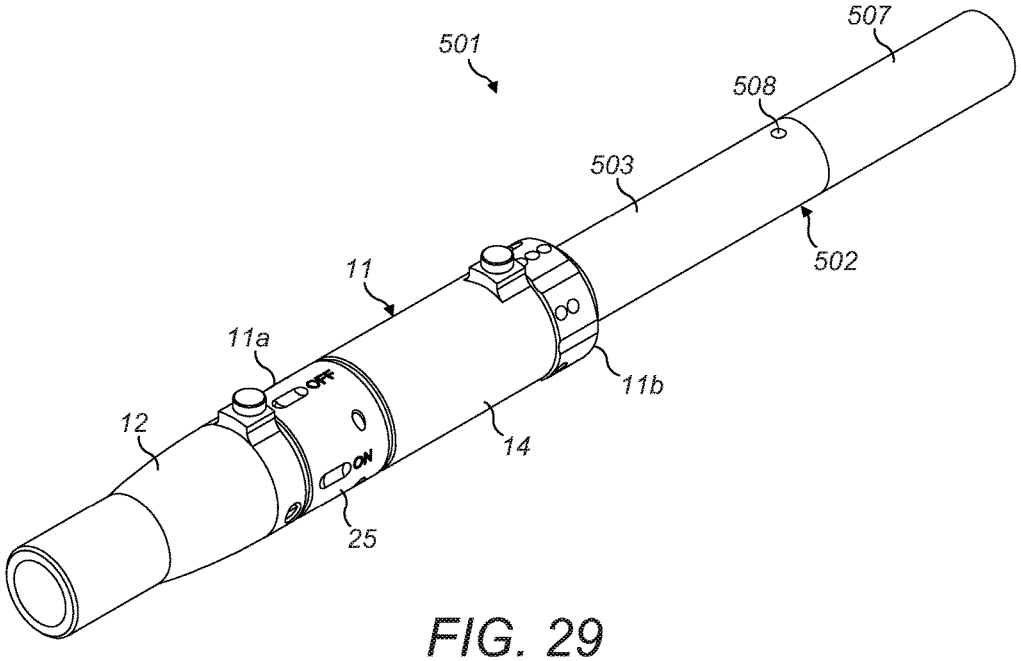
FIG. 29 shows a perspective view of an inhalation device of a sixth embodiment.
Figure 30:
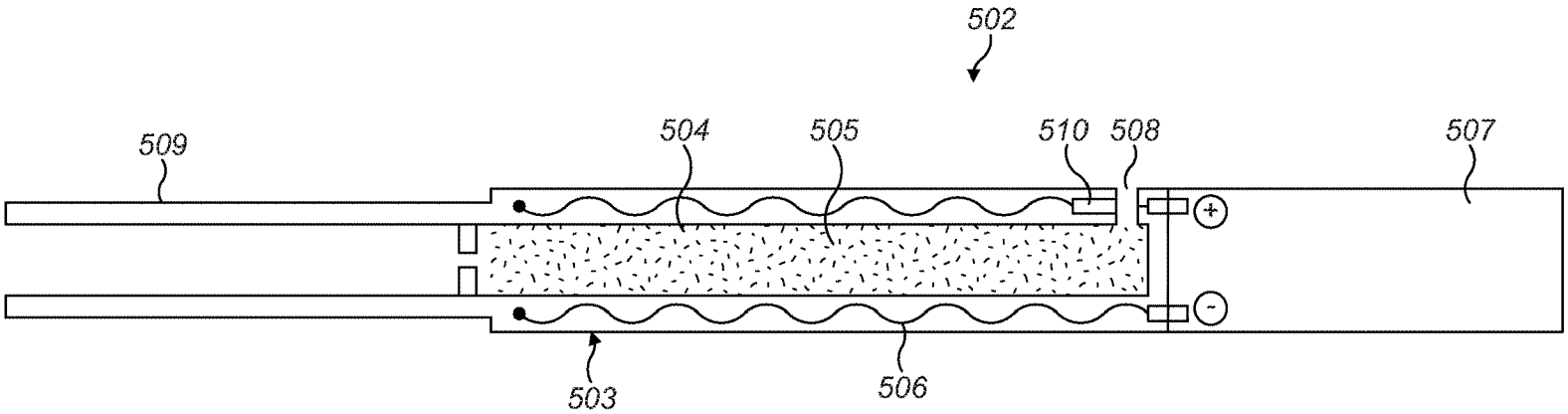
FIG. 30 shows a cross-sectional view through the inhalant-generating unit of the inhalation device of FIG. 29.

A sixth embodiment of an inhalation device 501 which does not operate by combustion to tobacco is show in FIGS. 29 and 30, and is similar to the first embodiment of FIGS. 1-15. Features of the controller body 11 and mouthpiece 12 which function to provide ventilation and flavour control are the same and so a description thereof will not be repeated. However, a difference between the sixth embodiment 501 and the first embodiment is that the device 501 of the sixth embodiment is not configured to receive a combustible tobacco rod and is not designed for smoke from combustion of a tobacco rod to be drawn through the inhalation device. Instead, the sixth embodiment 501 comprises a device in which tobacco is heated by a heat source to cause constituents of the tobacco to be released in a vapour phase to be drawn through the device and inhaled by a user. A vapour-generating unit 502 is connected to the second end 11*b* of the body n and comprises a cylindrical component 503 having a chamber 504 containing tobacco 505, and electrical heating elements 506 surrounding the chamber 504 configured to heat the tobacco 505 in the chamber 504. A power supply such as a battery 507 is provided at one end of the component 503 to provide power to the heating elements 506 and may be detachable from the rest of the component 503 for separate recharging.

An inlet orifice 508 is provided at one end of the component 503 in communication with the chamber 504 to allow air to be drawn into the chamber 504. An opposite end of the component 503 includes a connecting portion 509 configured to be received and retained within the second end 11*b* of the body n. The chamber 504 is open at the connecting portion 509 so as to define a gas flow path through the inhalation device 501 when the vapour generating unit 502 is connected to the body n, from the inlet orifice 508 to the mouthpiece 12. Therefore, air may be drawn into the chamber 504 via the inlet orifice 508, through the body n and the mouthpiece 12 when the user draws on the mouthpiece 12.

A pressure sensor 510 is provided at the orifice 508 to detect when air is being drawn into the chamber 504 and the unit 502 is configured such that the heating elements 506 are powered when a reduced pressure is detected by the sensor 510 when air is being drawn into the chamber 504. A processor (not shown) may be provided in the component 503 to control operation of the heating elements 506 in response to signals from the pressure sensor 510.

In use, a user draws on the mouthpiece 12 which draws air though the inlet orifice 508 and into the chamber 504. The sensor 510 detects the reduced pressure at the inlet orifice 508 and the heating elements 506 are powered, heating the tobacco 505 and caused vapour phase products to be released from the tobacco 505. The released vapour is then drawn out of the chamber 504 through the connecting portion 509, through the body 11 and mouthpiece 12 and is inhaled by the user. When the user stops drawing on the mouthpiece, the return to ambient pressure is detected by the sensor 510 and power to the heating elements 506 is stopped, stopping further heating of the tobacco until the user next draws on the mouthpiece.

As a user uses the inhalation device 501 of the sixth embodiment, they may choose to turn additional flavour on or off as described previously by rotation of the mouthpiece 12, and may also allow varying degrees of ambient external ventilation air into the vapour stream, to dilute and/or cool the vapour steam as desired, by rotation of the ventilation control sleeve 17 as described above.

Upon exhaustion of the tobacco source 505 in the vapour-generating unit 502, the unit 502 may be detached from the body by the ejection mechanism described above, or simply by being pulled out of the body, and replaced with a fresh unit. The component 503 portion of the vapour-generating unit 502 may be replaced with a new component 503 with a fresh full chamber 504 of tobacco 505, separately to replacement of the battery 507.

Figure 31:
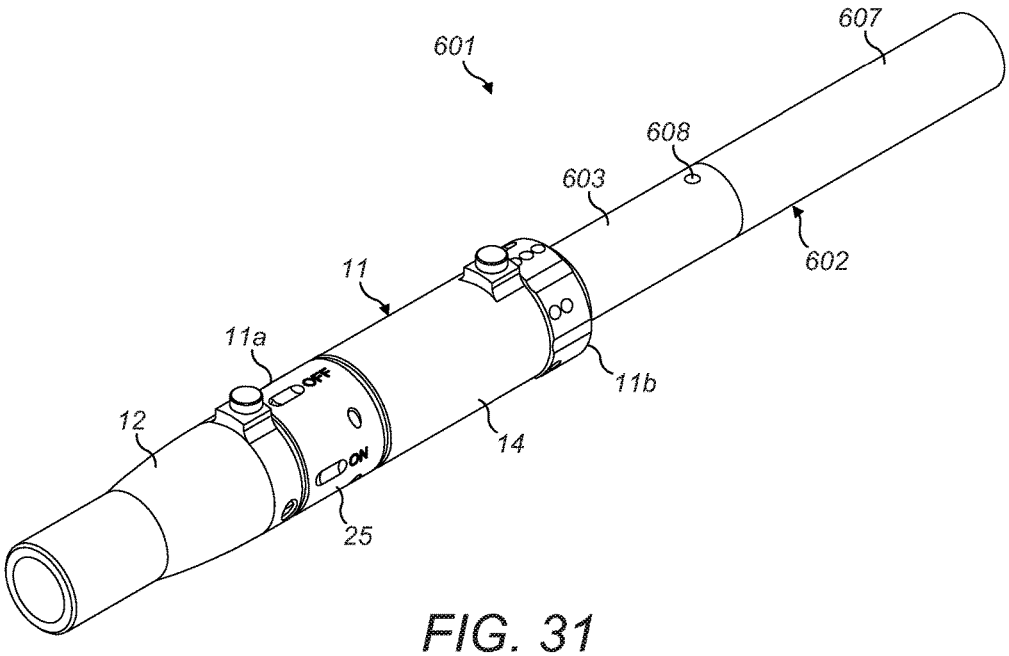
FIG. 31 shows a perspective view of an inhalation device of a seventh embodiment.
Figure 32:
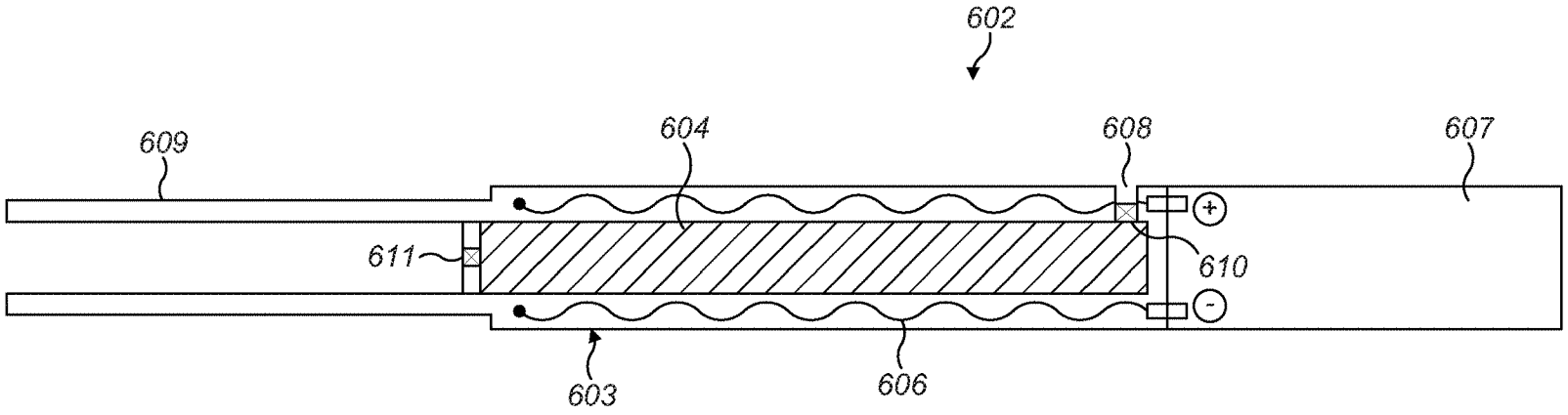
FIG. 32 shows a cross-sectional view through the inhalant-generating unit of the inhalation device of FIG. 31.

A seventh embodiment of an inhalation device 601 which also does not operate by combustion to tobacco is show in figures 31 and 32, and is similar to the sixth embodiment of FIGS. 29 and 30. Like features retain the same reference numerals and detailed description thereof will not be repeated. As with the sixth embodiment, the seventh embodiment is not configured to receive a combustible tobacco rod or for smoke from combustion of a tobacco rod to be drawn through the device. However, a difference between the seventh embodiment 601 and the sixth embodiment is that the device 601 of the seventh embodiment includes a different configuration of vapour-generating unit 602 connected to the second end 11*b* of the body 11. Here, the vapour generating unit 602 comprises a cylindrical component 603 having a chamber 604 containing nicotine solution, and electrical heating elements 606 surrounding the chamber 604 configured to heat the solution in the chamber to produce nicotine vapour. A power supply such as a battery 607 is provided at one end of the component 603 to provide power to the heating elements 606 and may be detachable from the rest of the component 603 for separate recharging.

An inlet orifice 608 is provided at one end of the component 603 in communication with the chamber 604 to allow air to be drawn into the chamber 604. The inlet orifice 608 may include a one-way valve 610. An opposite end of the component 603 includes a connecting portion 609 configured to be received and retained within the second end 11*b* of the body 11. The connecting portion 609 includes an open end and the chamber may include a one-way outlet valve 611 so that generated vapour may pass out of the chamber 604. A gas flow path can thereby be defined through the inhalation device 601 when the vapour generating unit 602 is connected to the body 11, from the inlet orifice 608 to the mouthpiece 12. Therefore, air may be drawn into the chamber 604 via the inlet orifice 608, through chamber 604, through the body 11 and the mouthpiece 12 when the user draws on the mouthpiece 12.

As with the sixth embodiment, a pressure sensor (not shown) may be provided at the orifice 608 to detect when air is being drawn into the chamber 604 and connected to a processor (not shown) to control the heating elements 606 to only be powered when a reduced pressure is detected by the sensor when air is being drawn into the chamber 604 by a user drawing on the mouthpiece.

In use, a user draws on the mouthpiece 12 which draws air though the inlet orifice 608 and into the chamber 604. The heating elements 606 are powered, heating the nicotine solution to generate nicotine vapour which is drawn out of the chamber 604 through the outlet valve 611, through the connecting portion 609, through the body 11 and mouthpiece 12 and is inhaled by the user.

In use of the inhalation device 601 of the seventh embodiment, the user may choose to turn additional flavour on or off as described previously by rotation of the mouthpiece 12, and may also allow varying degrees of ambient external ventilation air into the vapour stream, to dilute and/or cool the vapour steam as desired, by rotation of the ventilation control sleeve 17 as described above.

Upon exhaustion of the nicotine solution supply in the vapour-generating unit 602, the unit 602 may be detached from the body by the ejection mechanism described above, or simply by being pulled out of the body, and replaced with a fresh unit. The component 603 with fresh full chamber 604 may be replaced separately to the battery 607.

Although in the seventh embodiment, a flow path is described as extending from the inlet orifice 608, through the chamber 604 and through the connecting portion 609 into the body 11, in an alternative embodiment, ambient air may flow from the inlet orifice 608 into the component 603 but may flow within the component 603 in a passage that bypasses the chamber 604 and leads into the connecting portion 609. The chamber 604 may include a single outlet aperture, which may be provided with a one-way valve 611, through which vapour, generated by heating of the liquid within the chamber 604 by the heating elements 606, is expelled, to mix with the ambient air from the bypass passage, before being drawn through the body 11 of the inhalation device.

In the sixth and seventh embodiments described above, the inhalant-generating components are described as being removeably received in the body 11 of the inhalant device. However, it is intended within the scope of the invention that such inhalant-generating components may alternatively be formed integrally with the body and the entire device/apparatus may be discarded after use or once the inhalant-generating component is exhausted.

As used herein, the term inhalant may include smoke, aerosols, vapours or gases suitable for inhalation by a user As used herein, the terms "flavour" and "flavourant" refer to materials which, where local regulations permit, may be used to create a desired taste or aroma in a product for adult consumers.

In order to address various issues and advance the art, the entirety of this disclosure shows by way of illustration various embodiments in which the claimed invention(s) may be practiced and provide for superior inhalant apparatus and inhalation device. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An inhalation device configured to hold an inhalant-generating component to generate an inhalant to be drawn through the device and inhaled by a user, the inhalation device comprising:

a multi-use body having a first open end including a receiving portion configured to receive an inhalant generator, and a second open end in fluid communication with the first open end and through which, in use, a user can draw inhalant from the inhalant generator, the body configured to receive a flavor delivery component having an organoleptic material, wherein the inhalation device further comprises a flavor delivery mechanism comprising the flavor delivery component including the organoleptic material, and wherein the flavor delivery component is rotatable relative to the multi-use body to selectively allow or prevent addition of an organoleptic additive into an inhalant stream drawn through the device in use; and a ventilation control configured to selectively allow different amounts of ambient air into the body to mix with and dilute the inhalant stream as it is drawn through the device in use.

2. The inhalation device according to claim 1, wherein the ventilation control is moveable between a closed position in which no ambient air is introduced into the inhalant stream from the inhalant generator as inhalant is drawn through the smoking device in use, and a plurality of open positions in which different amounts of ambient air are introduced into the inhalant stream from the inhalant generator as inhalant is drawn through the smoking device in use.

3. The inhalation device according to claim 1, wherein the second open end of the body is configured to receive the flavor delivery component.

4. The inhalation device according to claim 1, wherein the flavor delivery component has a mouthpiece.

5. The inhalation device according to claim 4, wherein the flavor delivery component is connected to the second open end of the body.

6. The inhalation device according to claim 5, wherein the flavor delivery mechanism is switchable between a first position in which organoleptic additive is introduced into the inhalant stream in use, and a second position in which organoleptic additive is prevented from being introduced into the inhalant stream in use.

7. The inhalation device according to claim 6, wherein, in use, the inhalant stream bypasses the organoleptic material when the flavor delivery mechanism is in the second position.

8. The inhalation device according to claim 5, wherein the flavor delivery mechanism comprises an actuator that is rotatable relative to the body.

9. The inhalation device according to claim 8, wherein the flavor delivery component comprises the actuator.

10. The inhalation device according to claim 5, wherein the flavor delivery component is removably attached to the body.

11. The inhalation device according to claim 5, wherein the ventilation control mechanism is adjustable independently of the flavor delivery mechanism.

12. The inhalation device according to claim 5, further comprising a charcoal filter element disposed upstream of the flavor delivery mechanism.

13. The inhalation device according to claim 5, wherein one of the flavor delivery component and the body includes a recessed track and the other of the flavor delivery component and body includes a pin received in the recessed track such that the flavor delivery component is retained on the body.

14. The inhalation device according to claim 13, wherein the recessed track includes detents, in which the pin can locate, that correspond to first and second positions of the flavor delivery component, thereby defining stable rotational positions thereof.

15. The inhalation device according to claim 1, further comprising an ejector configured to eject the inhalant generator from the device.

16. The inhalation device according to claim 15, wherein the ejector is actuatable by a longitudinal force being exerted on an inhalant generator held in the device.

17. The inhalation device according to claim 15, wherein the ejector comprises a spring configured to eject the inhalant generator from the device.

18. An inhalant apparatus, comprising:

the inhalation device according to claim 1; and an inhalant generator received in the first end of the body.

19. The inhalation device according to claim 1, further comprising a smoking apparatus configured to hold a combustible tobacco rod to be smoked through the inhalation device and subsequently removed from the inhalation device and discarded.

20. The inhalation device according to claim 1, wherein the inhalation device is further configured to receive a vapor generation component comprising tobacco and a heat generator configured to heat the tobacco to generate inhalant vapor.

21. The inhalation device according to claim 1, wherein the inhalation device is further configured to receive a vapor generation component comprising a reservoir of liquid and a heat generator configured to heat the liquid to generate inhalant vapor.

22. A modular inhalant apparatus, comprising:

a reusable holder configured to receive replaceable inhalant generators, the holder including a body with a first open end and a second open end;

a mouthpiece removably attached to the first open end of the body;

an inhalant generator removably received in the second open end of the body; and a replaceable flavor additive element, rotatable with respect to the body and configurable to selectively introduce or prevent introduction of an organoleptic additive to an inhalant stream as it is drawn from the inhalant generator and out of the mouthpiece in use, the mouthpiece comprising the replaceable flavor additive element.

* * * * *